US006548962B1

(12) United States Patent
Shiokawa et al.

(10) Patent No.: US 6,548,962 B1
(45) Date of Patent: Apr. 15, 2003

(54) GAS DISCHARGE PANEL

(75) Inventors: Akira Shiokawa, Osaka (JP); Ryuichi Murai, Toyonaka (JP); Hiroyoshi Tanaka, Kyoto (JP); Yoshiki Sasaki, Shijounawate (JP); Masatoshi Kudoh, Ichikawa (JP); Masaki Aoki, Mino (JP); Hidetaka Higashino, Kyoto (JP); Kinzou Nonomura, Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/485,469

(22) PCT Filed: Aug. 18, 1998

(86) PCT No.: PCT/JP98/03654

§ 371 (c)(1),
(2), (4) Date: Dec. 8, 2000

(87) PCT Pub. No.: WO99/09579

PCT Pub. Date: Feb. 25, 1999

(30) Foreign Application Priority Data

Aug. 19, 1997 (JP) ..... 9-222213

(51) Int. Cl.[7] ..... G09G 3/10; H01J 17/49

(52) U.S. Cl. ..... 315/169.4; 313/584

(58) Field of Search ..... 315/169.1, 169.3, 315/169.4; 313/491, 551, 549, 581, 582, 583, 584; 345/55, 60, 76, 77

(56) References Cited

U.S. PATENT DOCUMENTS

| | | | | | |
|---|---|---|---|---|---|
| 3,716,742 | A | * | 2/1973 | Nakayama et al. | 313/587 |
| 3,845,241 | A | * | 10/1974 | Schwartz | 313/485 |
| 4,684,849 | A | * | 8/1987 | Otsuka et al. | 315/169.1 |
| 5,001,392 | A | | 3/1991 | Lee et al. | 313/584 |
| 5,068,890 | A | | 11/1991 | Nilssen | 379/90.01 |
| 5,371,437 | A | * | 12/1994 | Amano | 313/584 |
| 5,587,624 | A | | 12/1996 | Komaki | 313/584 |
| 5,640,068 | A | | 6/1997 | Amemiya | 313/582 |
| 5,757,131 | A | * | 5/1998 | Tsuchiya | 313/582 |
| 5,777,436 | A | * | 7/1998 | Lepselter | 313/572 |
| 5,789,862 | A | * | 8/1998 | Makino | 313/581 |

FOREIGN PATENT DOCUMENTS

| | | |
|---|---|---|
| DE | 4446187 | 2/1996 |
| EP | 782167 | 7/1997 |
| EP | 936655 | 8/1999 |
| JP | 53059367 | 5/1978 |
| JP | 63149053 | 9/1988 |
| JP | 2168533 | 6/1990 |
| JP | 2201846 | 8/1990 |
| JP | 355746 | 3/1991 |
| JP | 42029 | 1/1992 |
| JP | 44542 | 1/1992 |
| JP | 7288087 | 10/1995 |
| JP | 822772 | 1/1996 |
| JP | 8306318 | 11/1996 |
| JP | 9306367 | 11/1997 |
| JP | 10199427 | 7/1998 |
| WO | 9844532 | 10/1998 |

* cited by examiner

*Primary Examiner*—Don Wong
*Assistant Examiner*—Minh D A

(57) ABSTRACT

A gas discharge panel in which cell filled with a discharge gas are arranged as a matrix between a pair of opposed plates, and in which a pair of display electrodes on a surface of one of the pair of opposed plates extend across a plurality of cells in the direction of rows, where a gap between the pair of display electrodes has two discharge gap widths one of which is larger than the other. The voltage is lowered and the power consumption is properly restricted by starting the discharge at the discharge gap at a space having the smaller gap width. An excellent discharge efficiency is secured by sustaining the discharge at a space having the larger gap width.

51 Claims, 23 Drawing Sheets x
y
22 X ELECTRODE
34 ELECTRODE PITCH (CELL PITCH)
35 GAP WIDTH BETWEEN ADJACENT CELLS (120 μm)
22 X ELECTRODE
28 ADDRESS ELECTRODE
ELECTRODE PRONG Y1
11 CELL
12 CELL
Y2
Y3
Y'1
Y'2
Y'3
X1
X2
X'1
X'2
DISCHARGE SPACE 38
13 CELL
14 CELL
SECOND DISCHARGE GAP WIDTH 40 (40 μm)
Y ELECTRODE 23
FIRST DISCHARGE GAP WIDTH 39 (20 μm)
SECOND DISCHARGE GAP WIDTH 40 (40 μm)
Y ELECTRODE 23

5% OF Xe

10% OF Xe

2% OF Xe

GAS DISCHARGE PANEL

TECHNICAL FIELD

The present invention relates to a gas discharge panel used for a display device or the like. More particularly, the present invention relates to a PDP.

BACKGROUND ART

Recently, as the demand for high-quality large-screen TVs such as high definition TVs have increased, displays suitable for such TVs, such as Cathode Ray Tube (CRT), Liquid Crystal Display (LCD), and Plasma Display Panel (PDP), have been studied and developed. These displays have the following characteristics.

CRTs have been widely used as TV displays and excel in resolution and picture quality. However, the depth and weight increase as the screen size increases. Solution of this problem is a key to the production of large-screen CRTs. Therefore, it is considered that producing CRTs having a large screen size exceeding 40 inch is difficult.

LCDs have found wide spread use as monitors for computers due to excellent characteristics such as smaller power consumption, size, and weight than CRTs. However, large-screen LCDs have such technical problems to be solved as faint images and disordered gray-scale levels or color gradations which are caused because LCDs themselves do not emit light when displaying images. In addition, it is thought that a defect of narrow viewing angles, which is unique to LCDs, must be cleared in order to achieve large-screen LCDs.

On the other hand, unlike CRTs or LCDs, PDPs have an advantage that large-screen PDPs can be achieved with relatively small weights. Also, PDPs have a merit that they consume smaller electricity in spite of the driving method in which PDPs themselves emit light for displaying images. Therefore, at the present time when next-generation displays are sought for, large-screen gas discharge panels such as PDPs are especially studied and developed eagerly. Gas discharge panels with a 50-inch or more screen have already been developed.

PDPs are divided into two types: Direct Current (DC) and Alternating Current (AC). Of these types of PDPS, AC-type PDPs are now becoming typical since they are thought to be suitable for large screens.

Meanwhile, it is desired these days that in electric products to be developed for various purposes, the power consumption is restricted as much as possible. In the circumstance, the power consumption at actuation is expected to below even in gas discharge panels such as PDPs. The problem is especially important for gas discharge panels such as PDPs since there is a tendency that the power consumption of these products is increasing along with the trend toward large screen and high minuteness. To live up to the expectation for the small power consumption, the discharge efficiency that greatly affects the PDP performance needs to be improved.

As apparent from the above description, at present, the technique for restricting power consumption by improving the discharge efficiency has room for refinement in discharge panels such as PDPs.

BRIEF SUMMARY OF THE INVENTION

Is therefore an object of the present invention to provide a gas discharge panel, such as a PDP, securing excellent discharge efficiency and having a high display performance, while properly restricting the power consumption.

The above object is achieved by a gas discharge panel in which a plurality of cells filled with a discharge gas are arranged as a matrix between a pair of opposed plates, and in which a pair of display electrodes on a surface of one of the pair of opposed plates extend across a plurality of cells in the direction of rows, where a gap between the pair of display electrodes has a first discharge gap width and a second discharge gap width larger than the first discharge gap width.

More specifically, in the above gas discharge panel, the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between the product p·d and discharge efficiency, where p represents discharge gas pressure and d represents discharge gap width.

With the above-stated construction, when the electricity is supplied to the display electrodes, discharge is actuated in a space having the first discharge gap width at a voltage lower than conventional techniques. This improves the light emission efficiency of the PDP. This initial discharge is followed by efficient sustain discharge established in a space having the second discharge gap width. This provides excellent display.

The above gas discharge panel may take the following specific forms: one of the pair of display electrodes is branched into a first electrode prong and a second electrode prong, the other of the pair of display electrodes is positionally between the first electrode prong and the second electrode prong, a gap width between the first electrode prong and the other display electrode is the first discharge gap width, and a gap width between the second electrode prong and the other display electrode is the second discharge gap width; or each of the pair of display electrodes is branched into a plurality of electrode prongs, a predetermined electrode prong of one of the pair of display electrodes is positionally between a first electrode prong and a second electrode prong of the other of the pair of display electrodes, a gap width between the first electrode prong and the predetermined electrode prong is the first discharge gap width, and a gap width between the second electrode prong and the predetermined electrode prong is the second discharge gap width. With such a construction, in addition to the above effects, it is possible to establish an excellent address discharge while preventing occurrence of the cross talk.

The above gas discharge panel may take the following form: a gap between the pair of display electrodes has a plurality of gap widths in a direction perpendicular to a surface of the gas discharge panel, the plurality of gap widths including the first discharge gap width and the second discharge gap width.

The above construction facilitates the formation of the first discharge gap width and the second discharge gap width in a limited space. This is advantageous in producing highly minute cells.

The above gas discharge panel may take the following form: at least one of facing sides of the pair of display electrodes has one or more projections per cell, the first discharge gap width being formed between the one or more projections and the other of the pair of display electrodes, and the second discharge gap width being formed between the other of the pair of display electrodes and the at least one of facing sides of the pair of display electrodes at portions other than the one or more projections.

With the above-stated construction, it is possible to achieve the present invention only by adding slight improvement to display electrodes manufactured with a conventional technique. This provides an excellent effect in terms of the production cost.

BRIEF DESCRIPTION OF DRAWINGS

FIGS. 23A, 23B, and 23C are graphs showing characteristics (Paschen's curve) of discharge start voltage vs. Product p·d.

FIG. 23A shows the Paschen's curve when the percentage of Xe in the discharge gas is 5%.

FIG. 23B shows the Paschen's curve when the percentage of Xe in the discharge gas is 10%.

FIG. 23C shows the Paschen's curve when the percentage of Xe in the discharge gas is 2%.

FIG. 24A shows the discharge efficiency curve when the percentage of Xe in the discharge gas is 5%.

FIG. 24B shows the discharge efficiency curve when the percentage of Xe in the discharge gas is 10%.

FIG. 24C shows the discharge efficiency curve when the perceentage of Xe in the discharge gas is 2%.

BEST MODE FOR CARRYING OUT THE INVENTION

Embodiment 1

Figure 1:
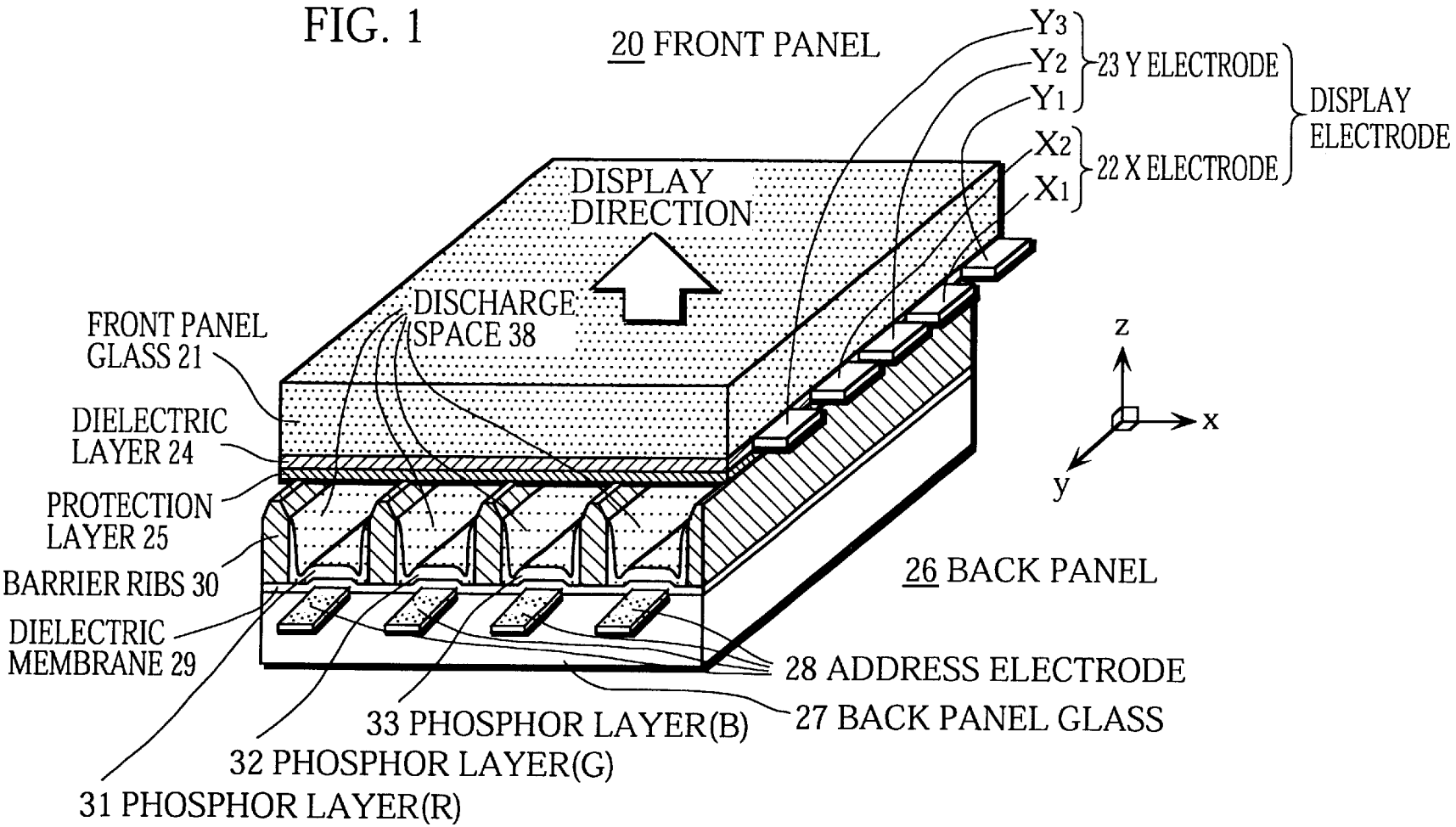
FIG. 1 is a partial, cross sectional perspective view of the PDP of Embodiment 1.

FIG. 1 is a partial, cross sectional perspective view of the AC surface-discharge type PDP of Embodiment 1. In the figure, the thickness of the PDP goes along the direction of z, the xy plane is parallel to the surface of the PDP. As shown in the drawing, the PDP is mainly provided with a front panel 20 and a back panel 26.

A front panel glass 21, which is a substrate of the front panel 20, is made of soda-lime glass. A pair of fork-shaped display electrodes 22 and 23 (X electrode 22 and Y electrode 23) is disposed on a surface of the front panel glass 21 facing the back panel 26, the display electrodes extending in the direction of x. The X electrode 22 has prongs X1 and X2; the Y electrode 23 has prongs Y1, Y2, and Y3. The prongs of the display electrodes 22 and 23 are alternately arranged in the direction of y in the order of Y1, X1, Y2, X2, and Y3. In every embodiment of the present invention, it is presumed in common that the X electrode 22 operates as a scanning electrode during an address discharge. The general view of the display electrodes 22 and 23 will be described later.

The surface of the front panel 20 on which the display electrodes 22 and 23 are disposed is coated with a dielectric layer 24 made of lead oxide base glass. This mean that the display electrodes 22 and 23 are embedded in the dielectric layer 24. An outer surface of the dielectric layer 24 is coated with a protection layer 25 made of magnesium oxide (MgO).

A back panel glass 27, which is a substrate of the back panel 26, is manufactured in the same way as the front panel glass 21. A plurality of address electrodes 28 are disposed on a surface of the back panel glass 27 facing the front panel 20, the address electrodes 28 extending in the direction of y. With a certain distance in the direction of z, the address electrodes 28 and the display electrodes 22 and 23 form a latticelike electrode disposition patten, when viewed from above. A dielectric membrane 29 made of the same material as the dielectric layer 24 is formed on the surface of the back panel glass 27. The address electrodes 28 is coated with the dielectric membrane 29. A plurality of barrier ribs 30 are formed along the direction of y on an outer surface of the dielectric membrane 29, where each of the barrier ribs 30 has a certain height and a certain thickness, and the barrier ribs 30 and the address electrodes 28 are formed. Sides of the ribs 30 and the bottom of the space between the ribs 30 on the dielectric membrane 29 are coated with phosphor layers 31 to 33 corresponding to red, green, and blue.

The protection layer 25 of the front panel 20 and the top of the barrier ribs 30 of the back panel 26 are bonded together with a sealing glass. Each space partitioned by the plurality of barrier ribs 30 is filled with a discharge gas including a rare gas, rendering each space a swath of discharge space 38 extending along the direction of y. Each area of the discharge space 38 intersecting with a pair of display electrodes 22 and 23 (in Embodiment 1, electrode prongs X1, X2, Y1, Y2, and Y3) is called a cell. Cells 11 to 14 are examples of such cells and will be described later. The cells 11, . . . as a whole form a matrix with rows in the x direction and columns in the y direction. It is possible for the present PDP to perform a matrix display by allowing each cell 11, . . . to emit light as required.

At actuation of the PDP, electricity is supplied to each of the electrodes 22, 23, 28 to establish two kinds of discharges: an address discharge in which electricity is supplied to space between the address electrode 28 and either of the X electrode 22 or the Y electrode 23 to control ON/OFF of light emission for each of the cells 11, . . . ; and a sustain discharge (surface discharge) in which electricity is supplied to space between each pair of the X electrode 22 and the Y electrode 23.

Figure 2:
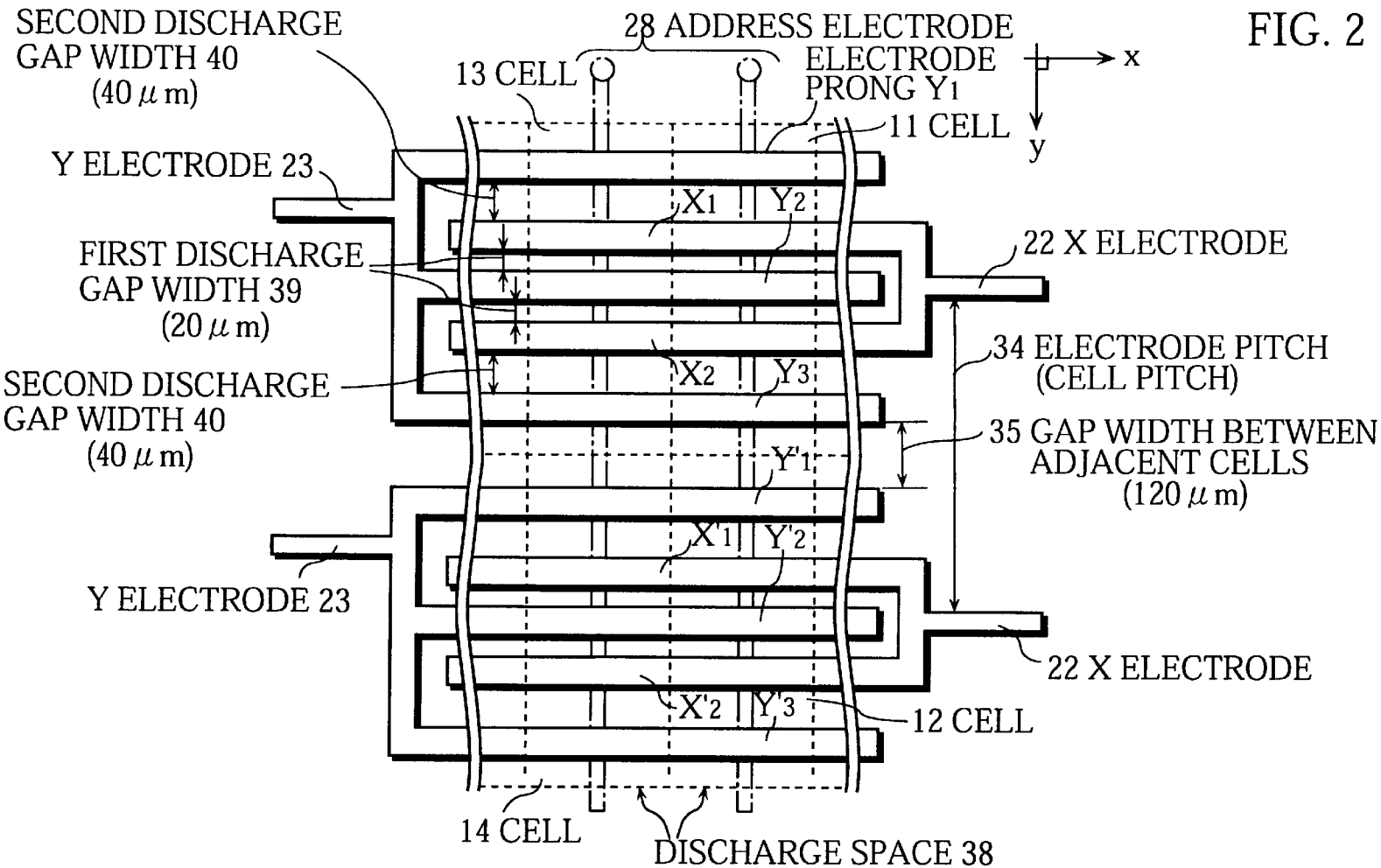
FIG. 2 is a top plan view showing a display electrode disposition pattern of the PDP of Embodiment 1.

FIG. 2 is a top plan view showing a display electrode disposition pattern of the present PDP viewed from above in the direction of z. The barrier ribs 30 are omitted from the drawing for simplification. Each area of the discharge space 38 encircled with a dotted line is cell 11, 12, 13, or 14.

The electrode prongs Y1, X1, Y2, X2, and Y3 (Y'1, X'1, Y'2, X'2, and Y'3) disposed in this order and corresponding to the cell 11 (cell 12) are each approximately 20 μm in width. The discharge gap width between the electrode prongs is either of the following two values:

(1) A first.discharge gap width 39 of approximately 20 μm such as a gap width between prongs X1 and Y2 and a gap width between prongs Y2 and X2 (a gap width between prongs Y'1 and X'1 and a gap width between prongs Y'2 and X'2). The first discharge gap width 39 is set in order to restrict the discharge start voltage to a lower value than conventional techniques.

(2) A second discharge gap width 40 of approximately 40 μm such as a gap width between prongs Y1 and X1 and a gap width between prongs X2 and Y3 (a gap width between prongs Y'1 and X'1 and a gap width between prongs X'2 and Y'3). The second discharge gap width 40 is set in order to secure a high light emission efficiency after the discharge start.

The reason why the above values are determined for the discharge gap widths will be described later.

A gap width 35 between the two cells 11 and 12 (cells 13 and 14) adjoining in the y direction and a gap width between prongs Y3 and Y'1 of the Y electrodes are each set to approximately 120 μm.

In the present PDP with the above construction, during the discharge period, electricity is supplied to the display electrodes 22 and 23 and pulse is applied. At this time, the surface discharge (initial discharge) starts in a space having the first discharge gap width 39. However, since the first discharge gap width 39 is relatively as narrow as approximately 20 μm, the discharge start voltage is lower than conventional techniques. This effectively restricts the power consumption of the PDP at the initial discharge.

Once the initial discharge starts, discharge is established also in a space having the second discharge gap width 40, as well as in a space having the first discharge gap width 39. This provides sufficient sustain discharge for superior light emission efficiency. As understood from the above, the PDP of the present embodiment performs the initial discharge and the sustain discharge using the discharge gap widths between the prongs X1, . . . properly in correspondence to each discharge.

Also, more Y electrode prongs are provided than X electrode prongs in the dielectric layer 24. For example, three Y electrode prongs Y1, Y2, and Y3 and two X electrode prongs X1 and X2 are disposed in the cell 11, the Y electrode prongs exceeding the X electrode prongs by one in the number. This prevents a cross talk from occurring between the prong X2 of the cell 11 and the prong Y'1 of the adjacent cell 12, for example. That is to say, the X electrode 22, which also acts as a scanning electrode, is protected by the Y electrode 23.

The PDP with the above construction is manufactured as follows.

Method of Producina PDP of Embodiment 1 i. Producina Front Panel 20

The fork-shaped display electrodes 22 and 23 respectively having prongs X1 and X2 and Y1, Y2, and Y3 are formed on a surface of the front panel glass 21 which is made of soda-lime glass and being approximately 2 mm in thickness, the display electrodes 22 and 23 being made of an electrically conductive, silver base material. A known method such as the screen printing method or the photo-etching method can be used to produce the fork-shaped display electrodes 22 and 23.

The dielectric layer 24 is then formed by applying a paste of lead base glass to the surface of display electrodes 22 and 23 as a whole so as to form a coat approximately 20 μm to 30 μm in thickness, and by baking the formed coat.

The front panel 20 is complete after the protection layer 25 approximately 1 μm in thickness made of magnesium oxide (MgO) is formed on the dielectric layer 24 with the vapor deposition or CVD (chemical vapor deposition) method.

ii. Producing Back Panel 26

The address electrodes 28 approximately 5 μm in thickness are formed by applying an electrically conductive, silver base material on a surface of the back panel glass 27 in stripes with a certain pitch with the screen printing method, the back panel glass 27 being made of soda-lime glass and approximately 2 mm in thickness. In this example, it is presumed that the PDP is manufactured for a 40-inch-class high definition TV. In accordance with this, the distance between adjoining address electrodes 28 is set to approximately 0.2 mm or less.

The dielectric membrane 29 is then formed by applying a paste of lead base glass to the surface of the back panel glass 27 as a whole, on which the address electrodes 28 have been formed, to form a coat of approximately 20 cm to 30 μm in thickness, and by baking the coat.

The barrier ribs 30 made of the same lead base glass as the dielectric membrane 29 and approximately 100 μm in height are then formed between each pair of adjoining address electrodes 28. The barrier ribs 30 are formed, for example, by repeatedly coating a paste of the lead base glass with the screen printing method and baking the coated paste.

After the barrier ribs 30 are formed, the phosphor layers 31, 32, and 33 are formed on sides of the barrier ribs 30 and the exposed surface of the dielectric membrane 29 between the barrier ribs 30 by applying phosphor ink for each of the three colors, red, green, and blue thereto, and drying and baking the applied ink.

The following are typical examples of the phosphors used for PDP:

red phosphor $(Y_xGd_{1-x})BO_3:Eu^{3+}$ green phosphor $Zn_2SiO_4$: Mn blue phosphor $BaMgAl_{10}O_{17}$: $Eu^{3+}$ (or $BaMgAl_{14}O_{23}$: $Eu^{3+}$).

The back panel 26 is completed with the above step.

It should be noted here that soda-lime glass, which is introduced as the material of the front panel glass 21 and the back panel glass 27, may be replaced with other materials. Similarly, the dielectric layer 24 and the protection layer 25 may be made of materials other than the specific ones described above. This is the same for the display electrodes 22 and 23, and for example, other materials may be selected to achieve excellent transparency of the display electrodes 22 and 23. In this way, it is possible to select various materials in a possible range for each embodiment.

iii. Completion of PDP

The front panel 20 completed as above is bonded to the back panel 26 with the sealing glass. Gas is released from the discharge space to produce a high vacuum ($8\times10^{-7}$ Torr), then the discharge space is filled with a Ne—Xe(5%) base discharge gas through the application of a certain pressure (in this example, 2000 Torr). This completes the PDP.

It should be noted here that other gases such as a He—Xe base gas and a He—Ne—Xe base gas may be used as the discharge gas.

In the succeeding embodiments, the description of the production of PDP will be mainly composed of characteristics of the display electrodes since most of the PDP production procedure is common to these embodiments except the shape and construction of the display electrodes.

In the present embodiment, each Y electrode has three prongs and each X electrode has two prongs in the cell 11, . . . as an example of a combination of (n+1) Y electrode prongs and n X electrode prongs, where n represents a natural number. Accordingly, each Y electrode may have two prongs and each X electrode may have one prong, for example. The present invention is not limited to this arrangement of the prongs. The present invention is achieved by any other combinations of prongs in which two types of gap widths, the first discharge gap width and the second discharge gap width, are secured for each of the cells 11, . . . and the prongs are arranged so as not to cause a cross talk between adjoining cells (e.g., cell 11 and cell 12). To achieve this purpose, it is desirable that different numbers of X electrodes and Y electrodes are assigned to each of the cells 11, . . . .

In the present embodiment, a gap width 35 between the cells 11 and 12 adjoining in the y direction is set to approximately 120 $\mu$m. However, the light emission efficiency will also be improved by disposing additional electrode prongs toward the boundary between the cells 11 and 12. In this case, the gap width 35 between the cells 11 and 12 may be removed if there is no risk of generating a cross talk which is caused, for example, when electrode prongs with different polarities are disposed to adjoin across the boundary between the cells 11 and 12.

The present embodiment shows an example in which the X electrode prong and the Y electrode prong have the same width. However, the X electrode prongs may be 1.5 to 3 times wider than Y electrode prongs. With this arrangement, the X electrode prongs function as scanning electrodes excellently and enough capacitance for address discharge is secured.

Typical AC surface-discharge type PDPs are supplied with electricity during the discharge period by applying several to several tens of pulses to the display electrodes. In the present embodiment, an alternative method is possible. That is, an electrode prong (e.g., electrode prong Y2 or Y'2) directly associated with the initial discharge may be wired independent of the other electrode prongs (e.g., electrode prongs Y1 and Y3, or Y'1 and Y'3) associated with the sustain discharge, and first several pulses in the discharge period may be applied to the electrode prong directly associated with the initial discharge so that the electricity is supplied, and the succeeding pulses may be applied to the electrode prongs associated with the sustain discharge. With this arrangement, discharge is established at the first discharge gap width only at an initial stage in the discharge period when there is a small number of charged particles (priming charged particles) in the discharge space, and no discharge is established at the first discharge gap width in the subsequent stage. This improves the light emission efficiency.

Figure 3:
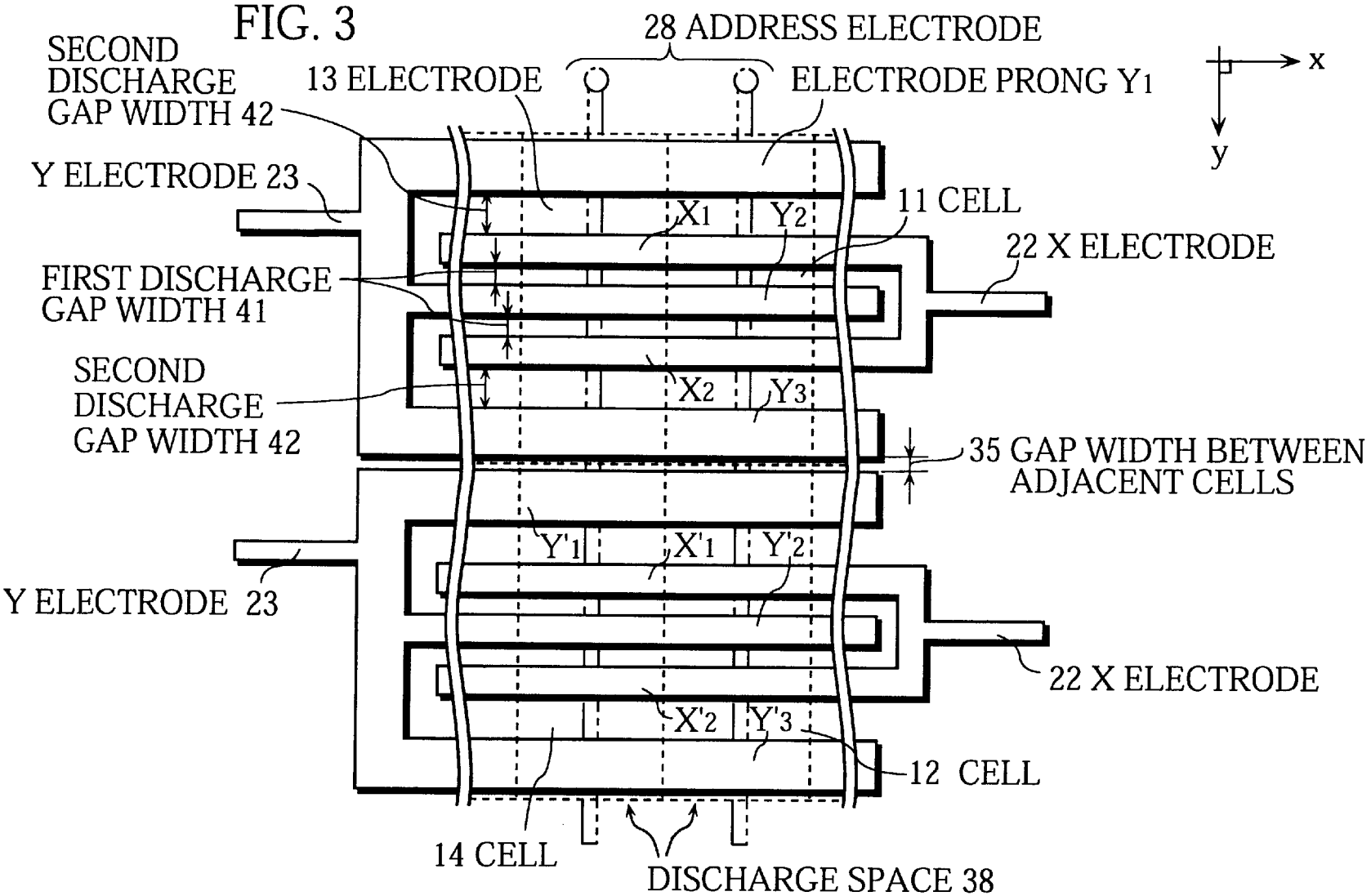
FIG. 3 is a top plan view showing a display electrode disposition pattern of a variation of Embodiment 1.

There is other methods for improving the light emission efficiency. For example, as shown in FIG. 3 which is a top plan view of a display electrode disposition pattern, Y electrode prongs Y3 and Y'1 are extended in width to near the boundary between cells 11 and 12. This increases the discharge area of the prongs Y3 and Y'1 and provides a large-scale sustain discharge. In this case, the contrast at PDP actuation improves if a black layer made of a metal such as black aluminum or black zinc is formed on a surface of the front panel glass 20 on which the electrode prongs Y3 and Y'1 have been formed. This is because the black layer prevents the display electrodes 22 and 23 from reflecting light and becoming prominent on the screen as white objects. Such a black layer can also be applied to the display electrodes of the PDPs in the other embodiments.

Embodiment 2

Figure 4:
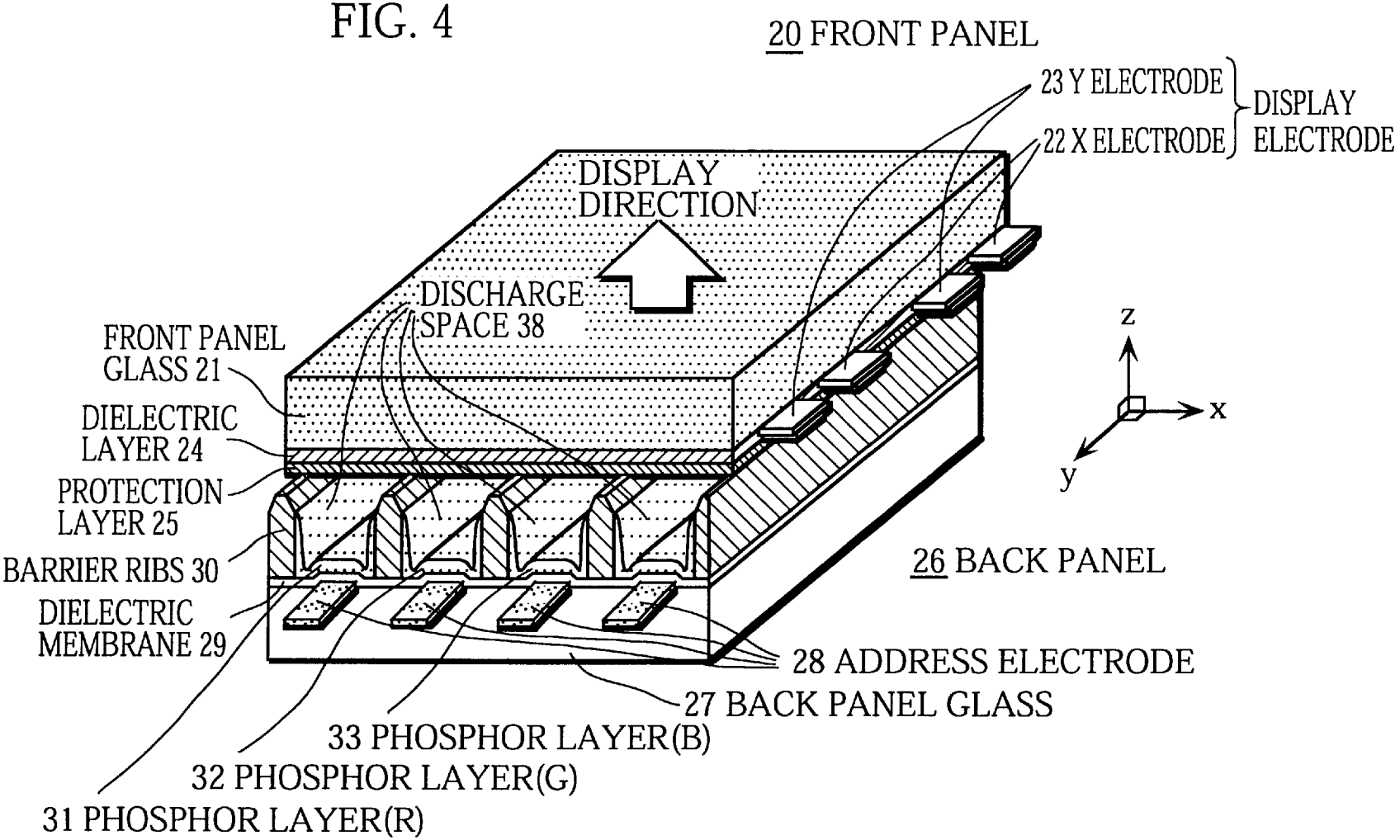
FIG. 4 is a partial, cross sectional perspective view of the PDP of Embodiment 2.

FIG. 4 is a partial, cross sectional perspective view of the AC surface-discharge type PDP of Embodiment 2. This PDP has almost the same construction as Embodiment 1 except that the display electrodes 22 and 23 are stacked in the direction of thickness (z) instead of having prongs.

Figure 5:
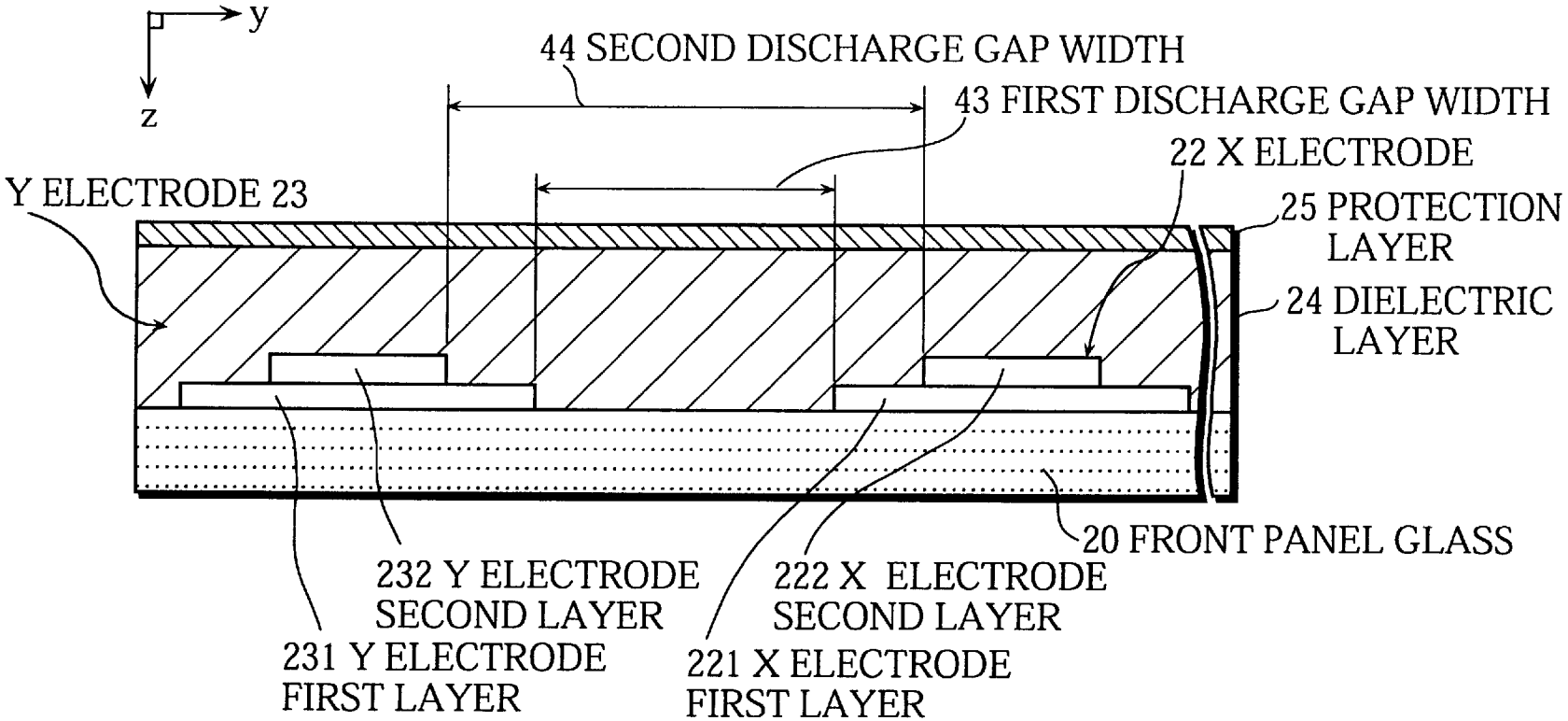
FIG. 5 is a partial, cross sectional view of display electrodes and their periphery of the PDP of Embodiment 2.

As shown in FIG. 5, a partial, cross sectional view of display electrodes and their periphery of the PDP, each of the X electrode 22 and Y electrode 23 is composed of two layers, first layers 221 and 231 and second layers 222 and 232, respectively stacked in the z direction. The second layers 222 and 232 have shorter width than the first layers 221 and 231. This construction provides a discharge gap having a plurality of widths between the display electrodes 22 and 23. That is to say, in the present embodiment, the gap between the Y electrode first layer 231 and X electrode first layer 221 has a first discharge gap width 43; and a gap between the Y electrode second layer 232 and X electrode second layer 222 has a second discharge gap width 44.

More specifically, the first layers 221 and 231 are approximately 40 $\mu$m to 80 $\mu$m in width and approximately 300 nm or less in thickness; the second layers 222 and 232 are approximately 20 $\mu$m in width and approximately 500 nm to 5000 nm (5 $\mu$m) in thickness. In FIG. 5, the first discharge gap width 43 and the second discharge gap width 44 are set to approximately 20$\mu$m and approximately 40 $\mu$m, respectively, as in Embodiment 1. The display electrodes 22 and 23 of the present construction are formed by repeatedly performing the screen printing to form a stack of layers and baking the formed layers.

In the PDP having the above construction, when the electricity supply is started by applying pulses to the display electrodes during the discharge period, first, the initial discharge is established in a space having the first discharge gap width 43 at the discharge start voltage, and the sustain discharge is established in a space having the second discharge gap width 44 at the discharge sustain voltage. In the present embodiment, the same effects as Embodiment 1 are obtained by the different voltages. Furthermore, in the present embodiment, the gap between a pair of display electrodes 22 and 23 has two discharge gap widths, the first discharge gap width 43 and the second discharge gap width 44. This construction relatively reduces the space for the gaps 43 and 44 and can be achieved even with highly minute cells.

In the present embodiment, the second layers 222 and 232 are wider than the first layers 221 and 231. However, the first and second layers may have the same width, and be stacked with a certain amount of displacement so that the first and second discharge gap widths are created.

Figure 6:
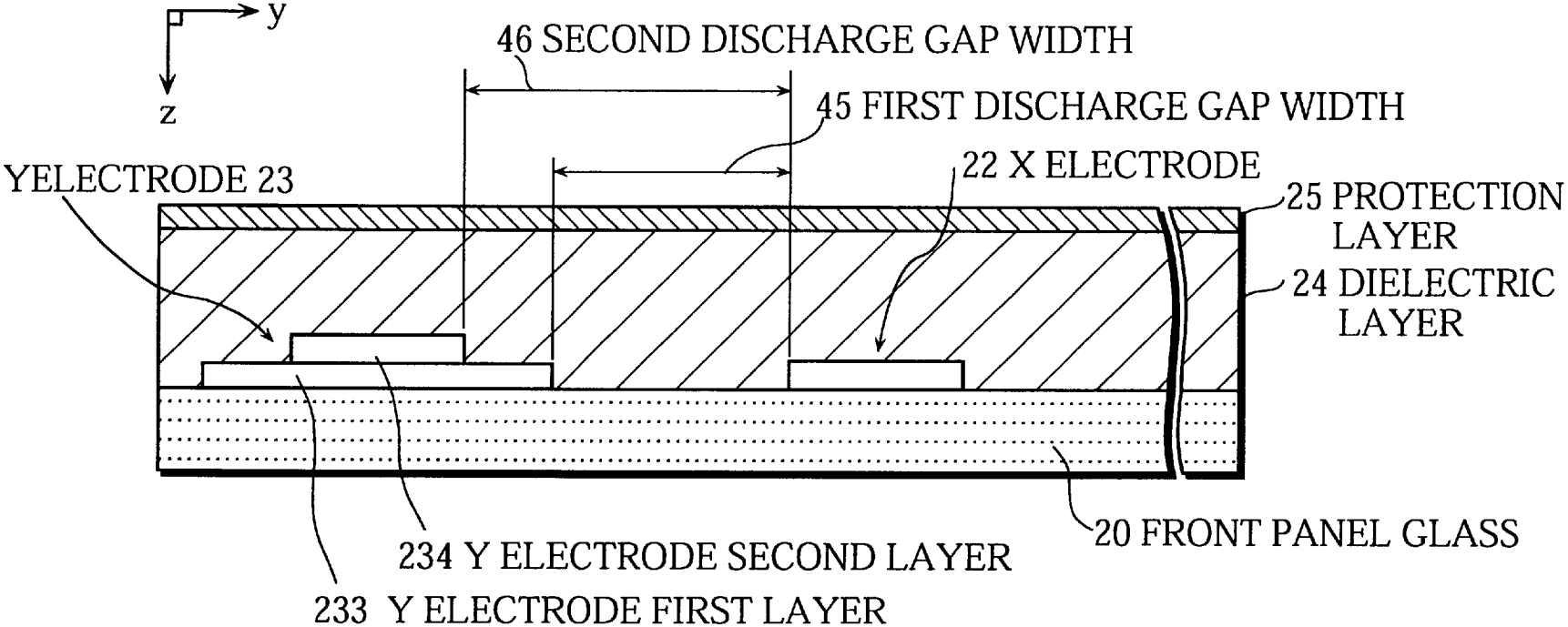
FIG. 6 is a partial, cross sectional view of display electrodes and their periphery of a variation of Embodiment 2.

The display electrodes is not limited to such a two-layer construction, but various constructions are possible in which the discharge gap between a pair of display electrodes 22 and 23 has a plurality of discharge gap widths including the first discharge gap width and the second discharge gap width in the z direction. For example, as shown in FIG. 6, a partial, cross sectional view of display electrodes and their periphery of the PDP, the first discharge gap width 45 and the second discharge gap width 46 may be created between a pair of display electrodes 22 and 23 by disposing the X electrode 22 having a one-layer construction and the Y electrode 23 composed of two layers: the first layer 233 and the second layer 234.

Figure 7:
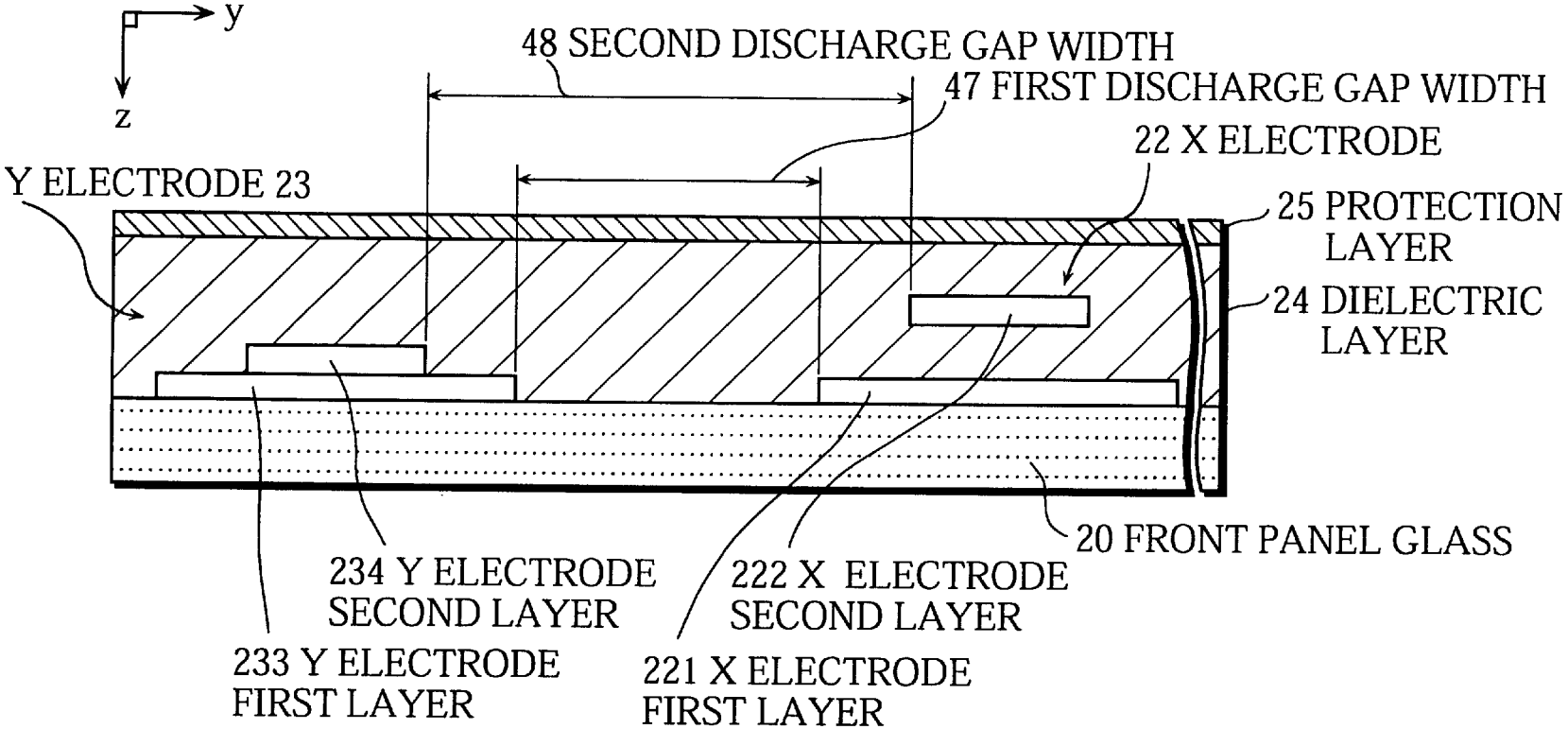
FIG. 7 is a partial, cross sectional view of display electrodes.and their periphery of a variation of Embodiment 2.

Alternatively, as shown in FIG. 7, a partial, cross sectional view of display electrodes and their periphery of the PDP, the first layer 221 and the second layer 222 of the X electrode 22 may be separated in the z direction with the dielectric layer 24 in between. This construction provides a second discharge gap width 48 between the second layer 234 and the second layer 222. In this case, the X electrode 22 operates excellently since the amount of capacitance around the X electrode 22 increases. Another discharge gap width, or a first discharge gap width 47 is secured between the first layers 221 and 233.

Figure 8:
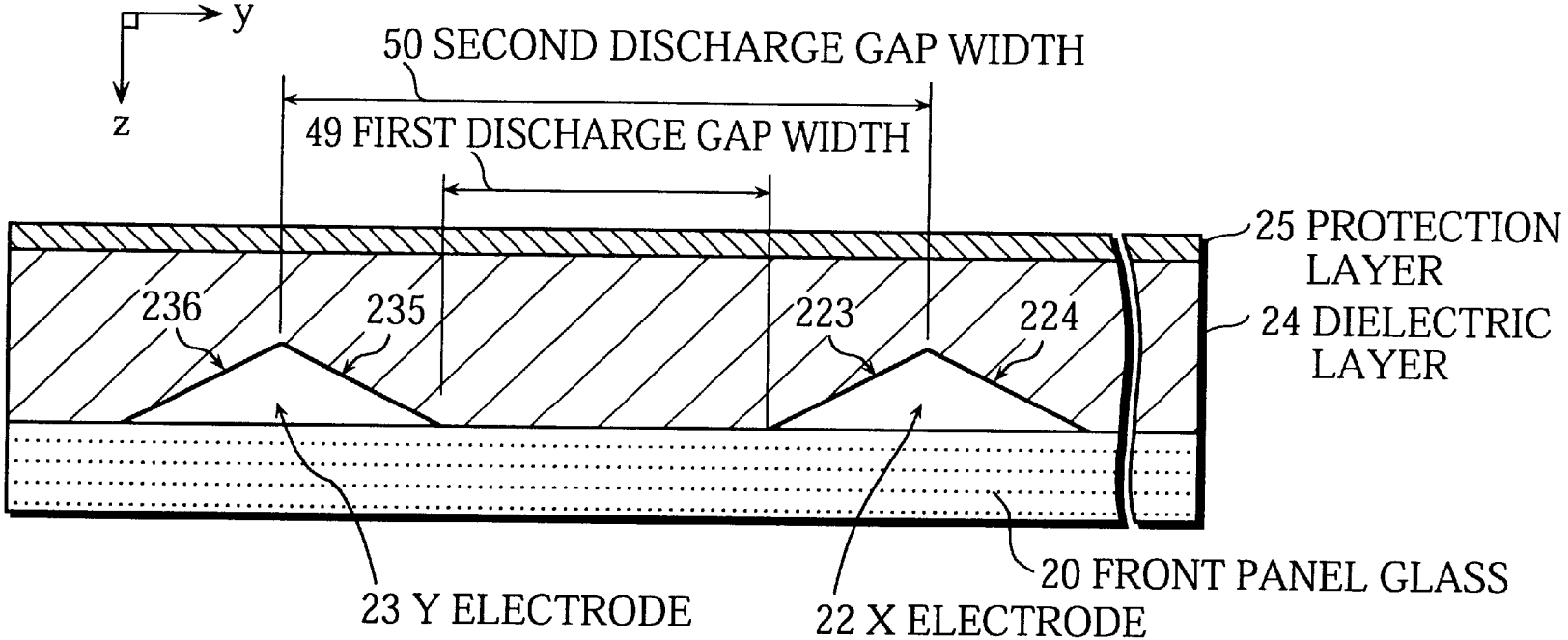
FIG. 8 is a partial, cross sectional view of display electrodes and their periphery of a variation of Embodiment 2.

Also, the display electrodes 22 and 23 may have other constructions other than the above two-layer construction. For example, as shown in FIG. 8, a partial, cross sectional view of display electrodes and their periphery of the PDP, the X electrode 22 and the Y electrode 23 may be shaped into triangles in cross section respectively having slanting sides 223 and 224 and slanting sides 235 and 236 so that the shortest gap width between facing slanting sides 223 and 235 matches the first discharge gap width 49 and the distance between the tops of the X electrode 22 and the Y electrode 23 matches the second discharge gap width 50. With this construction, a number of discharge gap widths associated with the sustain discharge are created, except the first discharge gap width 49. This improves the discharge efficiency. The display electrodes with this construction can also be formed by repeatedly performing the screen printing to form a plurality of layers, and baking the formed layers.

Figure 9:
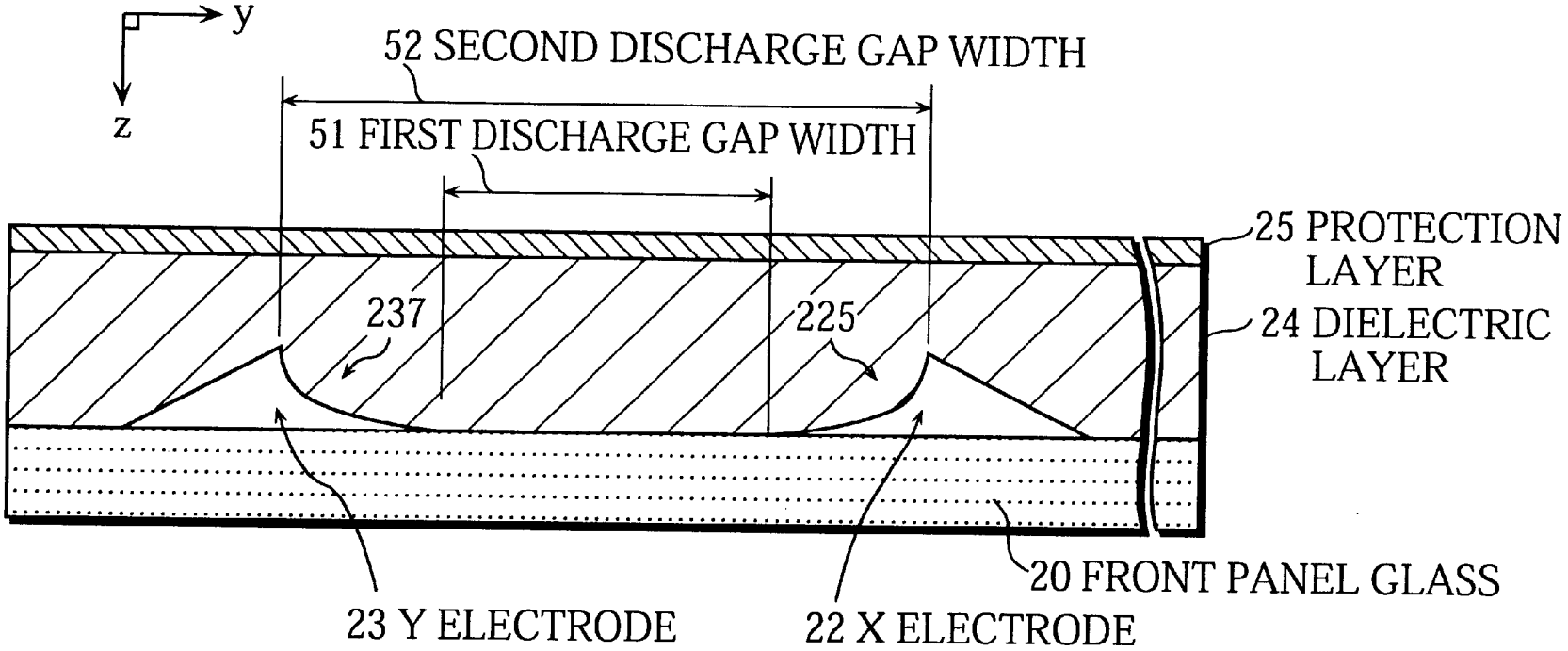
FIG. 9 is a partial, cross sectional view of display electrodes and their periphery of a variation of Embodiment 2.

Also, as shown in FIG. 9, a cross sectional view of the PDP, the facing slanting sides 223 and 235 may be replaced with curved sides 225 and 237. With this construction, the first discharge gap width 53 is secured while the width associated with the sustain discharge between the facing sides including the second discharge gap width 52 increases as a whole.

Figure 10:
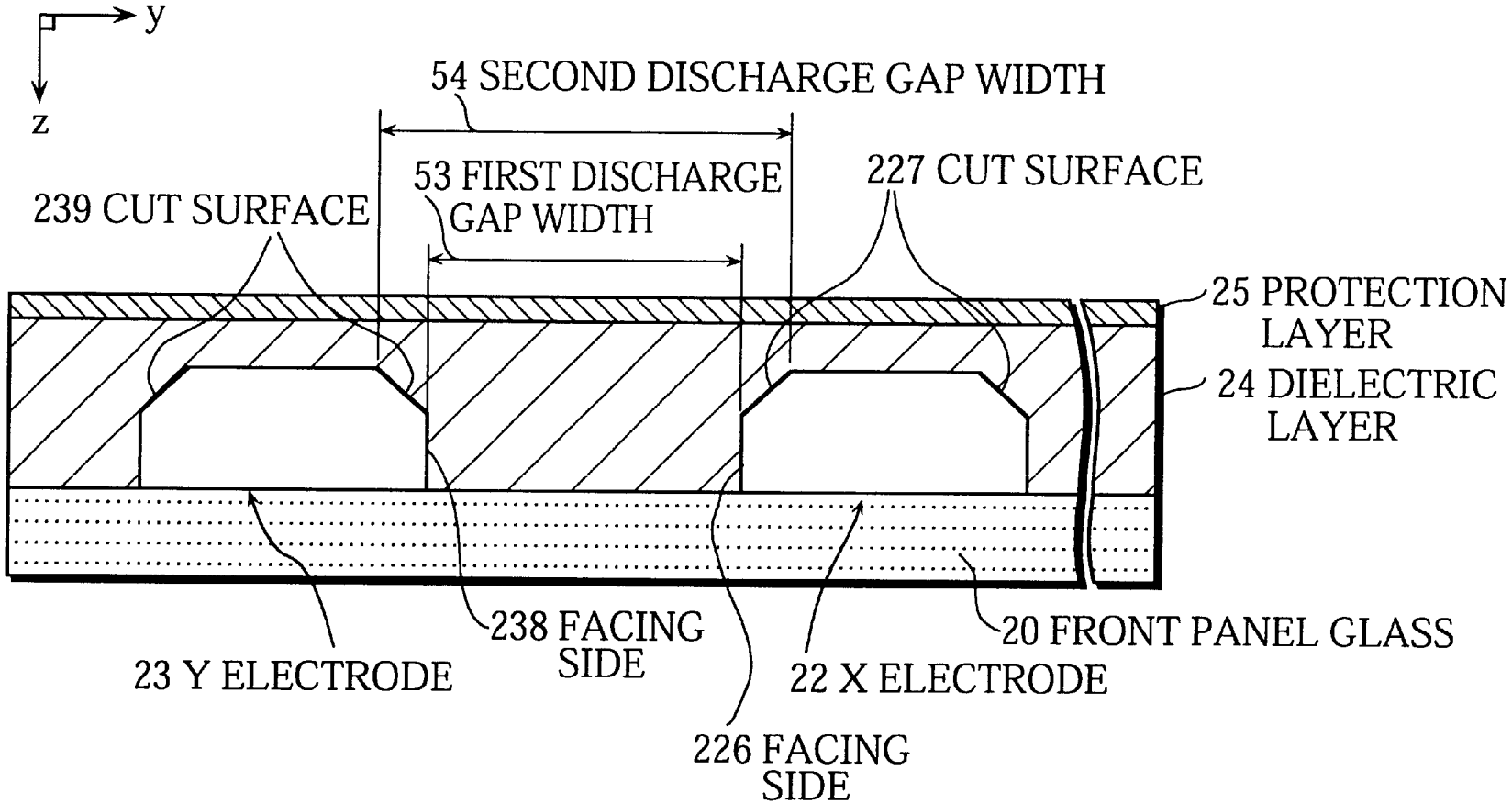
FIG. 10 is a partial, cross sectional view of display electrodes and their periphery of a variation of Embodiment 2.

If it is difficult to produce the above triangular display electrodes 22 and 23, the display electrodes 22 and 23 may be formed into other shapes with simpler methods. For example, as shown in FIG. 10, the display electrodes 22 and 23 may respectively have cut surfaces 227 and 239 which are formed first by forming ordinary display electrodes 22 and 23 having rectangular shapes in cross section, then cutting corners of the rectangular display electrodes. In this case, the amount of cut is adjusted so that the shortest gap width between facing cut surfaces 227 and 239 and the gap width between the facing sides 226 and 238 each match the first discharge gap width 53 and the longest gap width matches the second discharge gap width 54. The cut surfaces 227 and 239 are formed first by forming the X electrode 22 and the Y electrode 23, and cutting corners of the electrodes 22 and 23 with the known, over-etching method.

Embodiment 3

In Embodiment 2, a plurality of gap widths are secured between a pair of display electrodes along the direction of thickness (direction of z). In the present embodiment, the gap between each pair of display electrodes has a plurality of discharge gap widths including the first and second discharge gap widths along the plane of the front panel 20 (xy plane).

Figure 11:
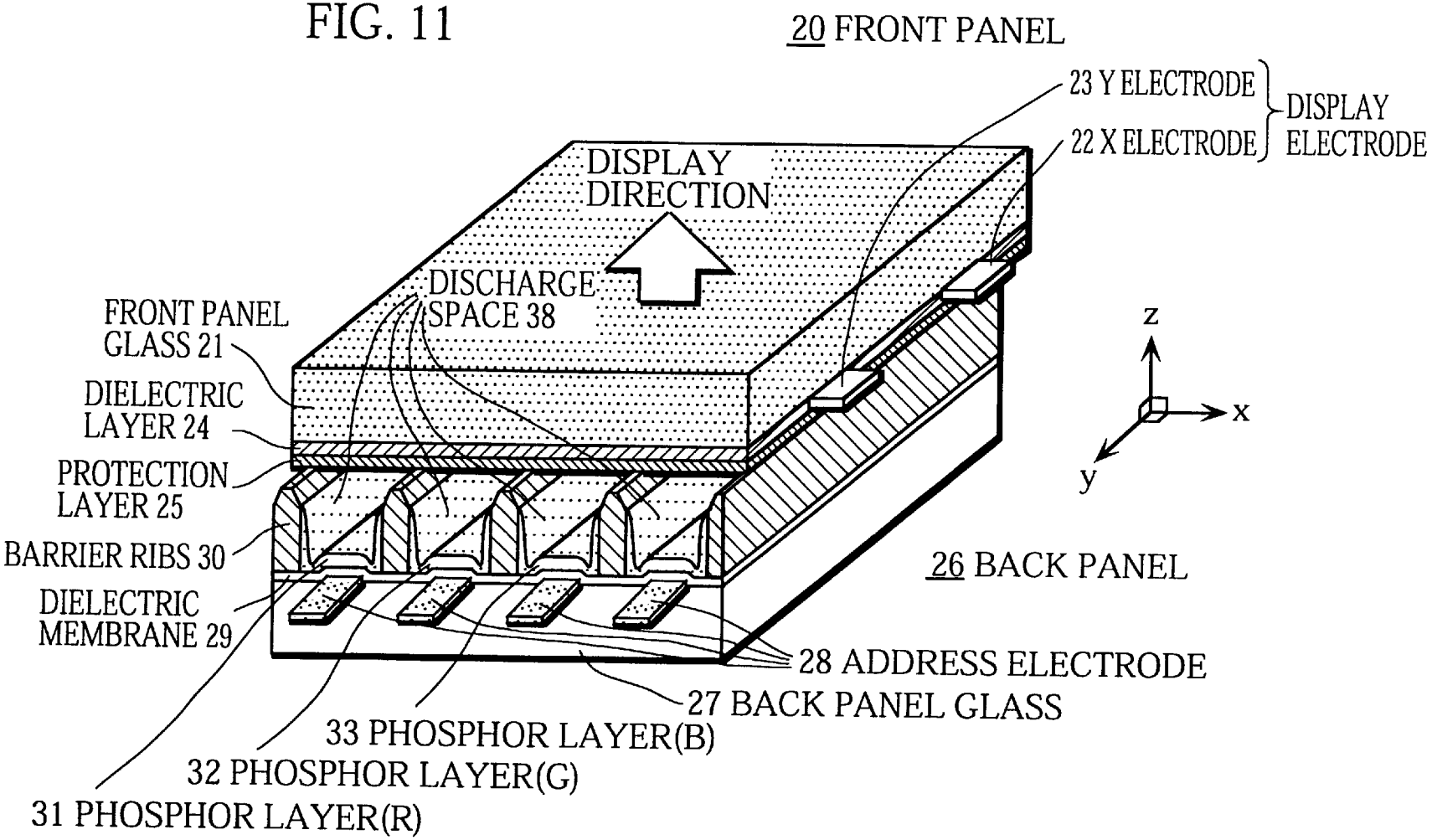
FIG. 11 is a partial, cross sectional perspective view of the PDP of Embodiment 3.
Figure 12:
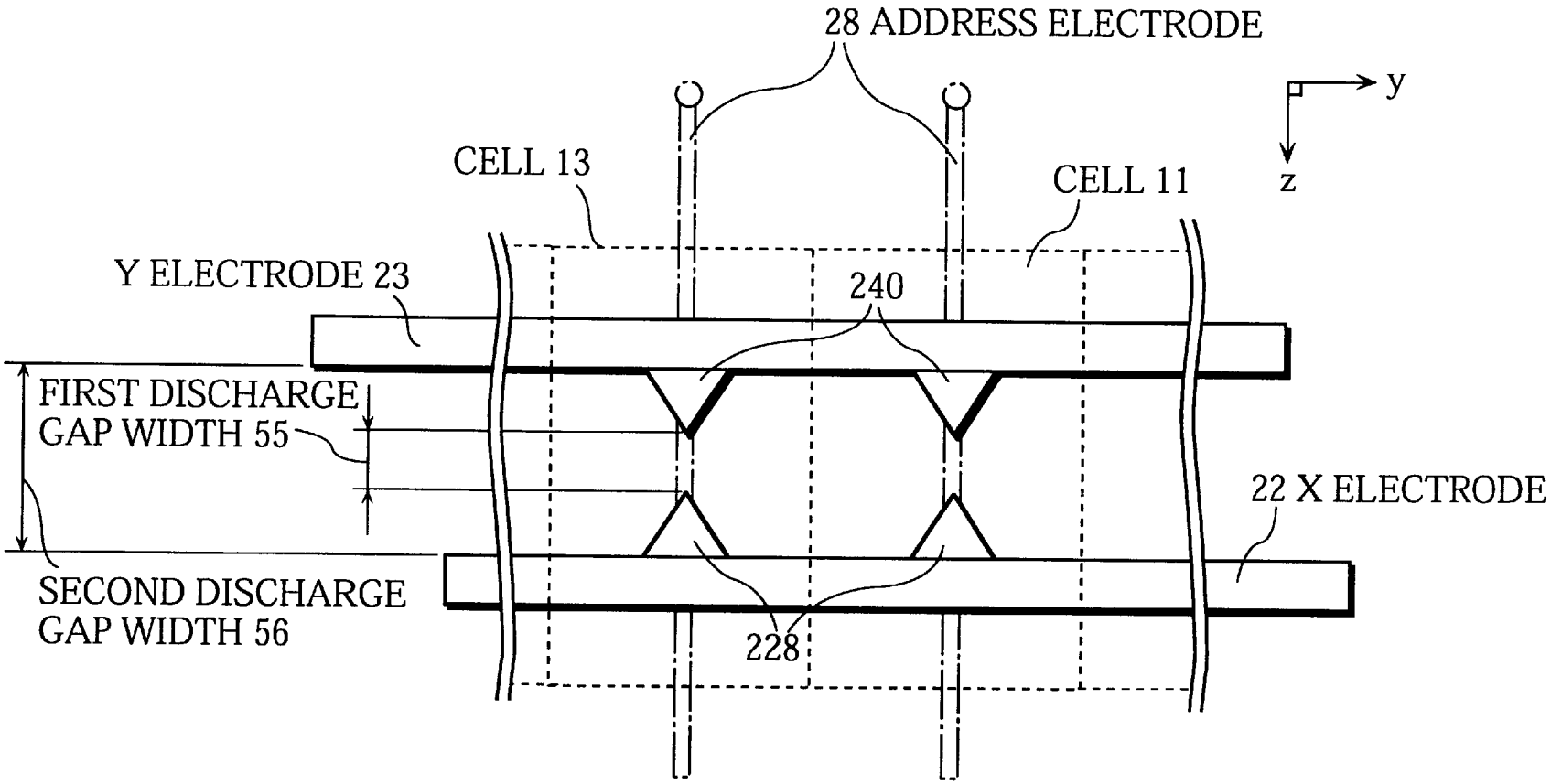
FIG. 12 is a top plan view showing a display electrode disposition pattern of the PDP of Embodiment 3.

The above construction will be described in more detail. As shown in FIG. 11 which is a partial, cross sectional perspective view of the AC surface-discharge type PDP of Embodiment 3, a pair of display electrodes 22 and 23 (each being approximately 20 $\mu$m in width) is formed, each being a single layer. As shown in FIG. 12 which is a top plan view of a display electrode disposition pattern, a pair of facing triangular projections 228 and 240 (each being approximately 10 $\mu$m in height) lies in the inner area of each of cells 11 and 13, where the X electrode 22 and the Y electrode 23 respectively have projections 228 and 240. A first discharge gap width 55 is secured between tips of the projections 228 and 240; a second discharge gap width 56 is secured between portions of the pair of display electrodes 22 and 23 other than the projections 228 and 240. Note that in FIG. 12, the projections 228 and 240 are illustrated larger than their actual size for clarity's sake.

In the present PDP with the above construction, when the electricity supply is started by, applying pulses to the display electrodes 22 and 23 during the discharge period, first, the electricity concentrates and the initial discharge is established at the discharge start voltage in a space between the tips of the projections 228 and 240, namely, in a space having the first discharge gap width 55. As a result, the discharge start voltage is effectively reduced and the initial discharge is actively established. Also, discharge gap widths other than the first discharge gap width 55 between the tips of the projections 228 and 240 are used for the sustain discharge. As a result, the sustain discharge is performed on an enough scale at the discharge gap having a plurality of widths including the second discharge gap width 56.

The present embodiment especially has an advantage that the display electrodes having the projections 228 and 240 can be manufactured without difficulty by patterning such display electrodes at a time using the screen printing method. This contributes reduction in the manufacturing costs.

Figure 13:
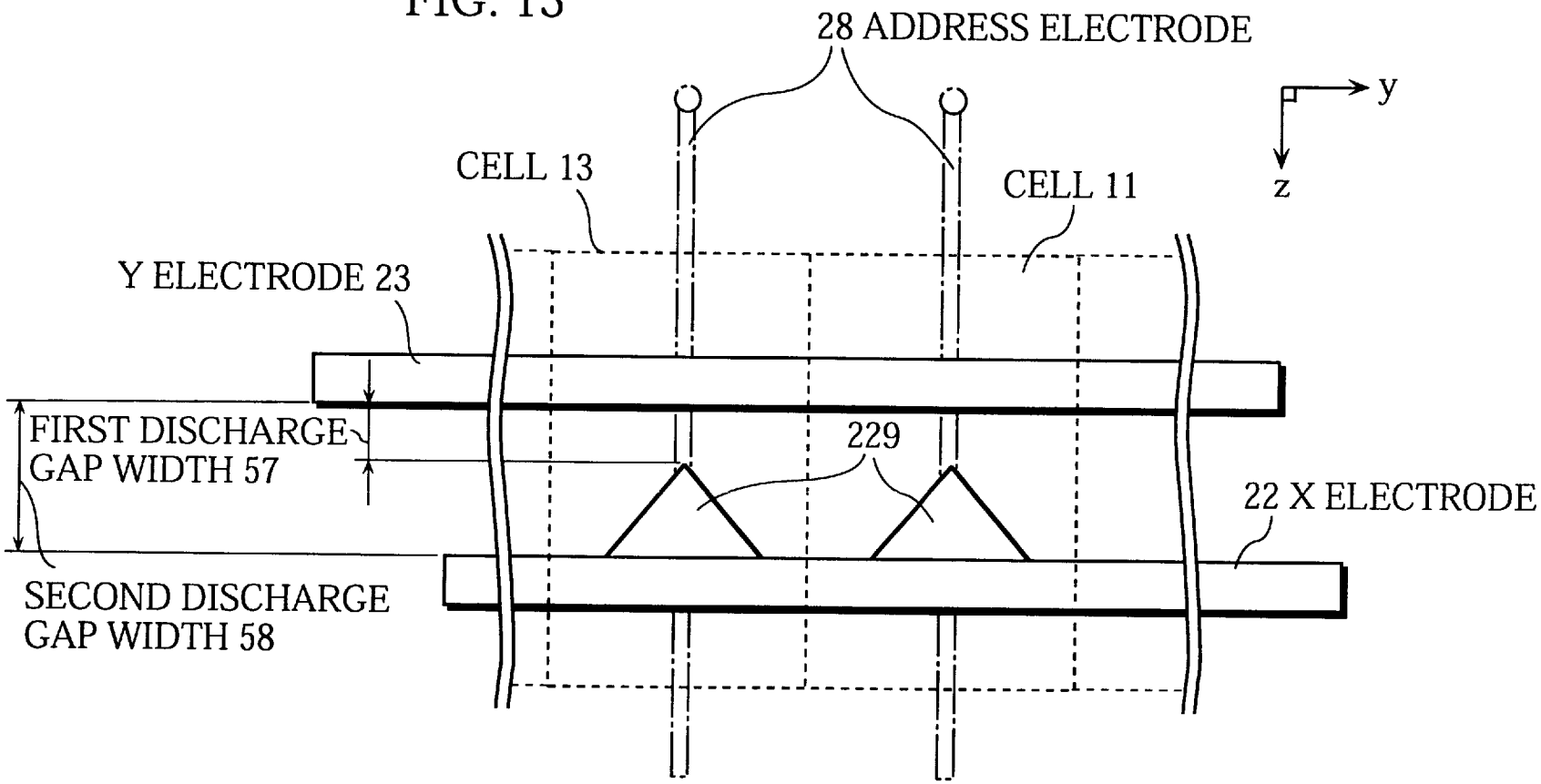
FIG. 13 is a top plan view showing a display electrode disposition pattern of a variation of Embodiment 3.

In the present embodiment, tips of a pair of projections 228 and 240 of a pair of display electrodes 22 and 23 face to each other. However, this embodiment is not limited to this construction. For example, the projections may be formed on only one of the display electrodes 22 and 23. For example, in FIG. 13, the projections 229 are formed only on the X electrode 22 so that the gap between the tip of the projections 229 and the opposing display electrode (the Y electrode 23) has the first discharge gap width 57 and that the gap between portions other than the projections of the display electrodes 22 and 23 has the second discharge gap width 58 between.

Figure 14:
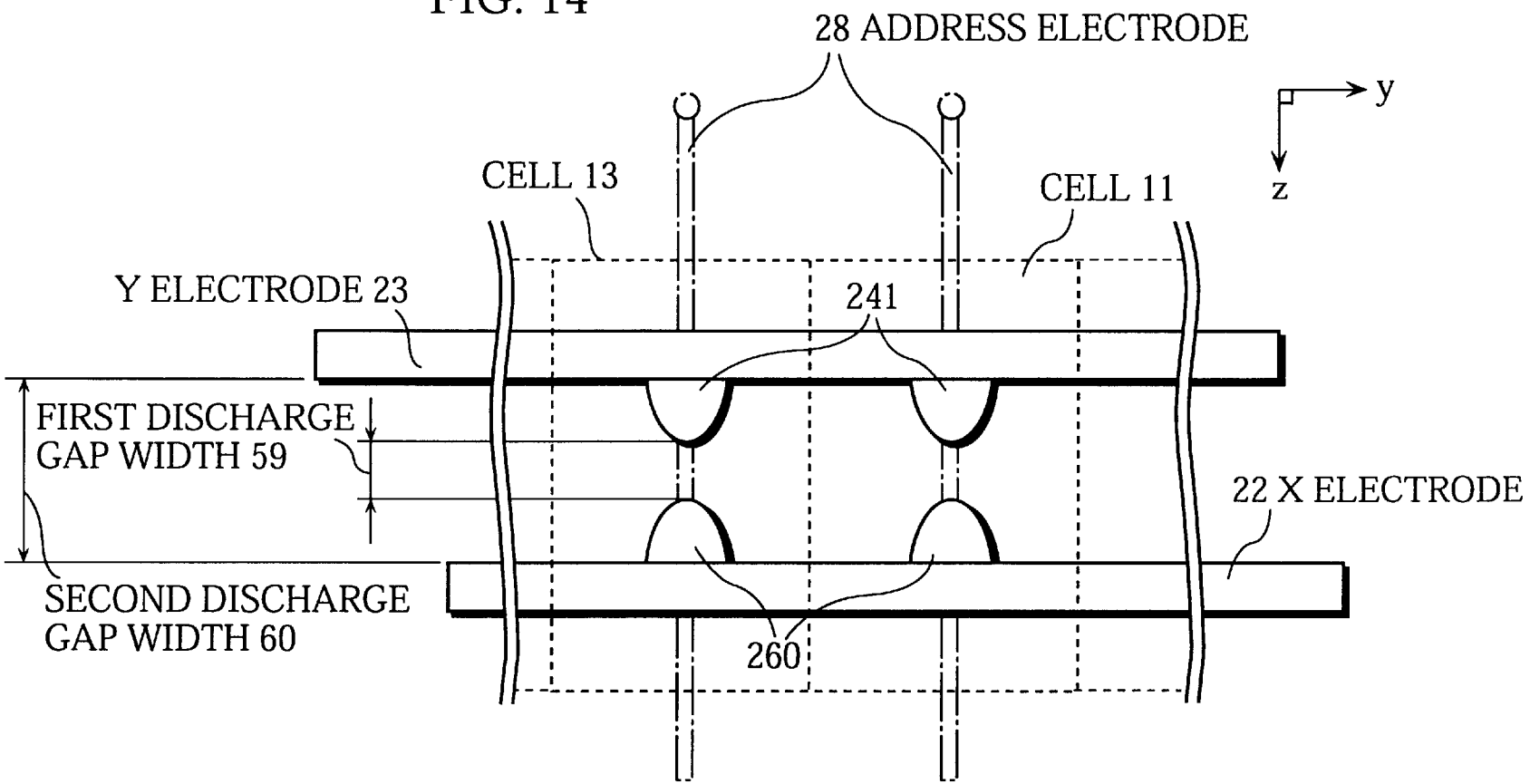
FIG. 14 is a top plan view showing a display electrode disposition pattern of a variation of Embodiment 3.

Furthermore, the shape of the projection is not limited to triangle. For example, as shown in FIG. 14, parabola-shaped projections 241 and 260 may be used so that the first discharge gap width 59 and the second discharge gap width 60 are obtained.

In the present embodiment, tips of a pair of projections of a pair of display electrodes 22 and 23 are aligned to oppose each other. However, the positions of the tips may be displaced and the projections may be larger than the half of the second discharge gap width in height (that is, double height of the projection may be larger than the second discharge gap width), and the shortest gap width between a pair of projections may be set as the first discharge gap width.

Furthermore, the number of projections may be increased in accordance with the cell size, or certain projections may have different shapes.

Embodiment 4

Figure 15:
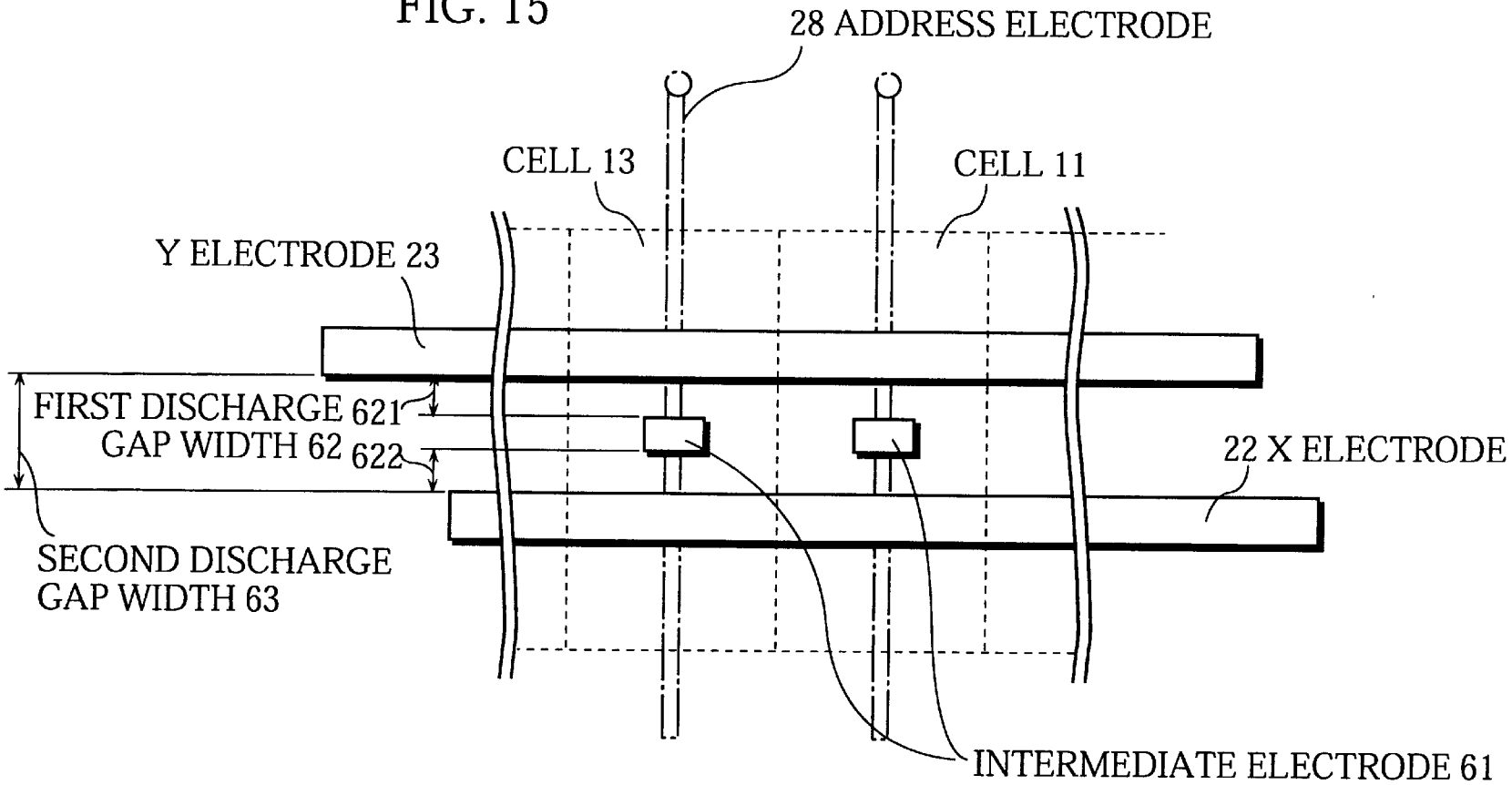
FIG. 15 is a top plan view showing a display electrode disposition pattern of the PDP of Embodiment 4.

The PDP of the present embodiment has the same construction as that shown in the cross sectional perspective view FIG. 11 except that as shown in FIG. 15 being a top plan view of the PDP's electrode disposition pattern, a pair of the X electrode 22 and the Y electrode 23 are disposed in parallel to oppose each other in each of the cells 11 and 13, and an intermediate electrode 61 is disposed almost at the center of each of the cells 11 and 13, where the intermediate electrodes 61 are each as large as can be inserted in an inner area of the cells 11 and 13, and are made of an electrically insulated conductive material.

Figure 16:
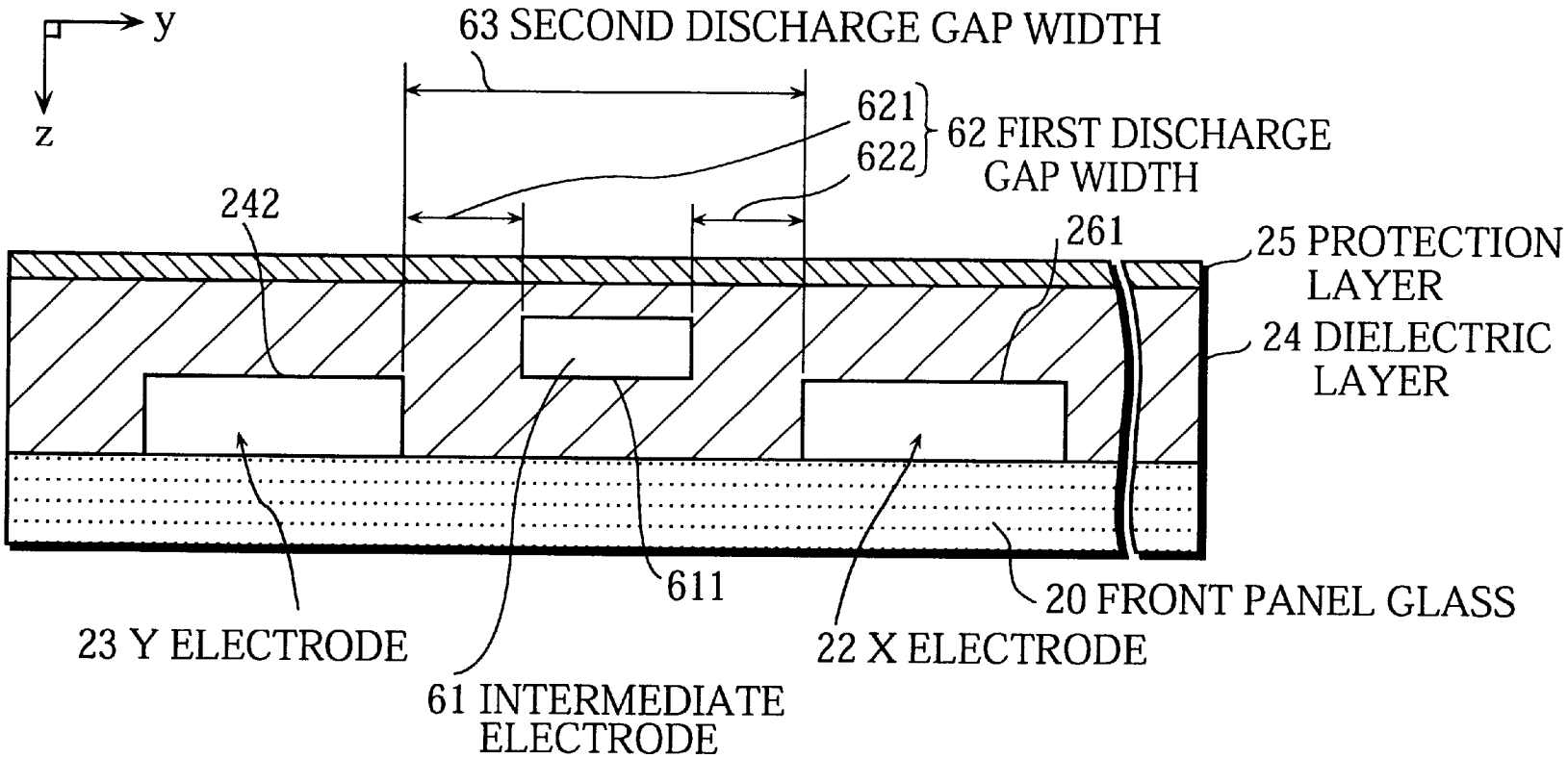
FIG. 16 is a cross sectional view of display electrodes and their periphery of the PDP of Embodiment 4.

FIG. 16 is a cross sectional view of the present PDP. The display electrodes 22 and 23 are approximately 5 $\mu$m in thickness and approximately 20 $\mu$m in width. The intermediate electrode 61, a rectangular solid located midway between the electrodes 22 and 23, is approximately 5 $\mu$m in thickness (in the z direction), approximately 20 $\mu$m in width (in the y direction), and approximately 20 $\mu$m in length (in the x direction). In the present embodiment, a sum of a gap width 621 between the intermediate electrode 61 and the Y electrode 23 and a gap width 622 between the X electrode 22 and the intermediate electrode 61 (10 $\mu$m+10 $\mu$m) constitutes a first discharge gap width 62; and a gap width between a pair of display electrodes 22 and 23 constitutes a second discharge gap width 63 (approximately 40 $\mu$m). Note that the distance between a bottom 611 of the intermediate electrode 61 and the surface of the front panel glass 20 is set to be approximately equivalent to the height of the X electrode 22 and the Y electrode 23 (i.e., the distance between an upper surface 261 of the X electrode 22 or an upper surface 242 of the Y electrode 23 and the surface of the front panel glass 20) so that the intermediate electrode 61 does not block the discharge gap between a pair of opposed X electrode 22 and Y electrode 23. The intermediate electrode 61 can be produced with the screen printing method in a manner similar to that for the display electrodes 22 and 23.

In the present PDP with the above construction, when the electricity supply is started by applying pulses to the display electrodes 22 and 23 during the discharge period, the capacitance relatively increases at around positions in the dielectric layer 24 where the display electrodes 22 and 23 respectively oppose to the intermediate electrode 69. As a result, discharge is easily established in a space having the first discharge gap width 62 even at a low start voltage.

The initial discharge established as above is followed by sustain discharge established in a space having the second discharge gap 63. In this sustain discharge, discharge is established in a broad area between the display electrodes 22 and 23. As a result, the sustain discharge is performed on an enough scale. This contributes to the improvement of the light emission efficiency of the PDP.

Figure 17:
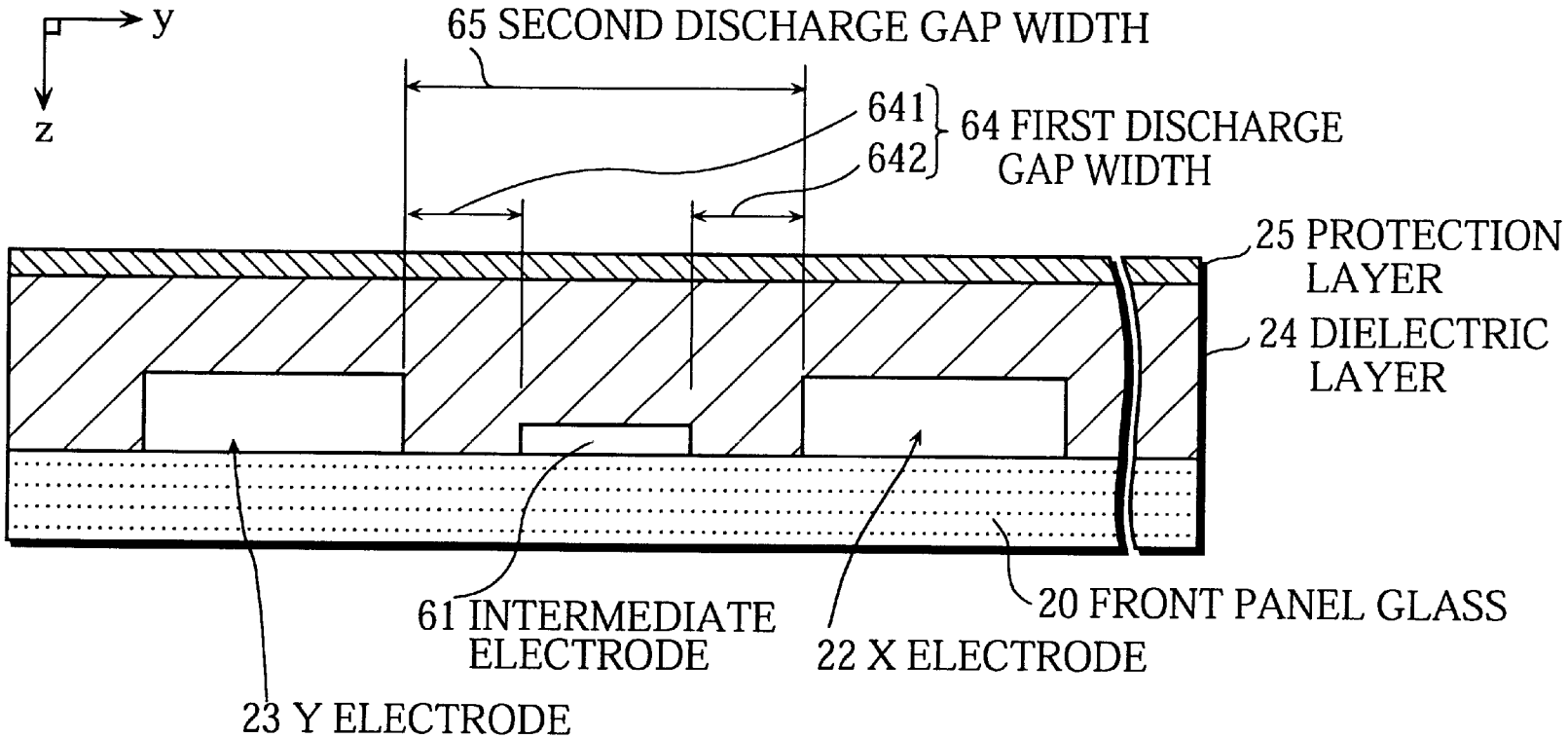
FIG. 17 is a cross sectional view of display electrodes and their periphery of a variation of Embodiment 4.

In the present embodiment, the distance between a bottom 611 of the intermediate electrode 61 and the surface of the front panel glass 20 is set to be approximately equivalent to the height of the X electrode 22 and the Y electrode 23 (i.e., the distance between an upper surface 261 of the X electrode 22 or an upper surface 242 of the Y electrode 23 and the surface of the front panel glass 20). This arrangement is made so that the intermediate electrode 61 does not block the discharge gap between a pair of opposed X electrode 22 and Y electrode 23. For this purpose, as shown in a cross sectional view FIG. 17, the intermediate electrode 61 may be enough thinner than the display electrodes 22 and 23 to secure the second discharge gap width 63.

It should be noted here that the intermediate electrode should be disposed at around the center of a pair of display electrodes. There is a risk of increasing the discharge start voltage if the intermediate electrode is significantly deviated from the center position.

The shape of the intermediate electrode is not limited to a rectangular solid, but may be ellipsoid whose longitudinal axis is parallel to the x direction, for example.

Also, the size of the intermediate electrode is not limited to that disclosed in the present embodiment. However, to prevent the occurrence of a cross talk between cells adjoining in the x direction, it is desirable that the intermediate electrode has an enough size to be apart from the barrier ribs 30 for a certain extent.

Embodiment 5

Figure 18:
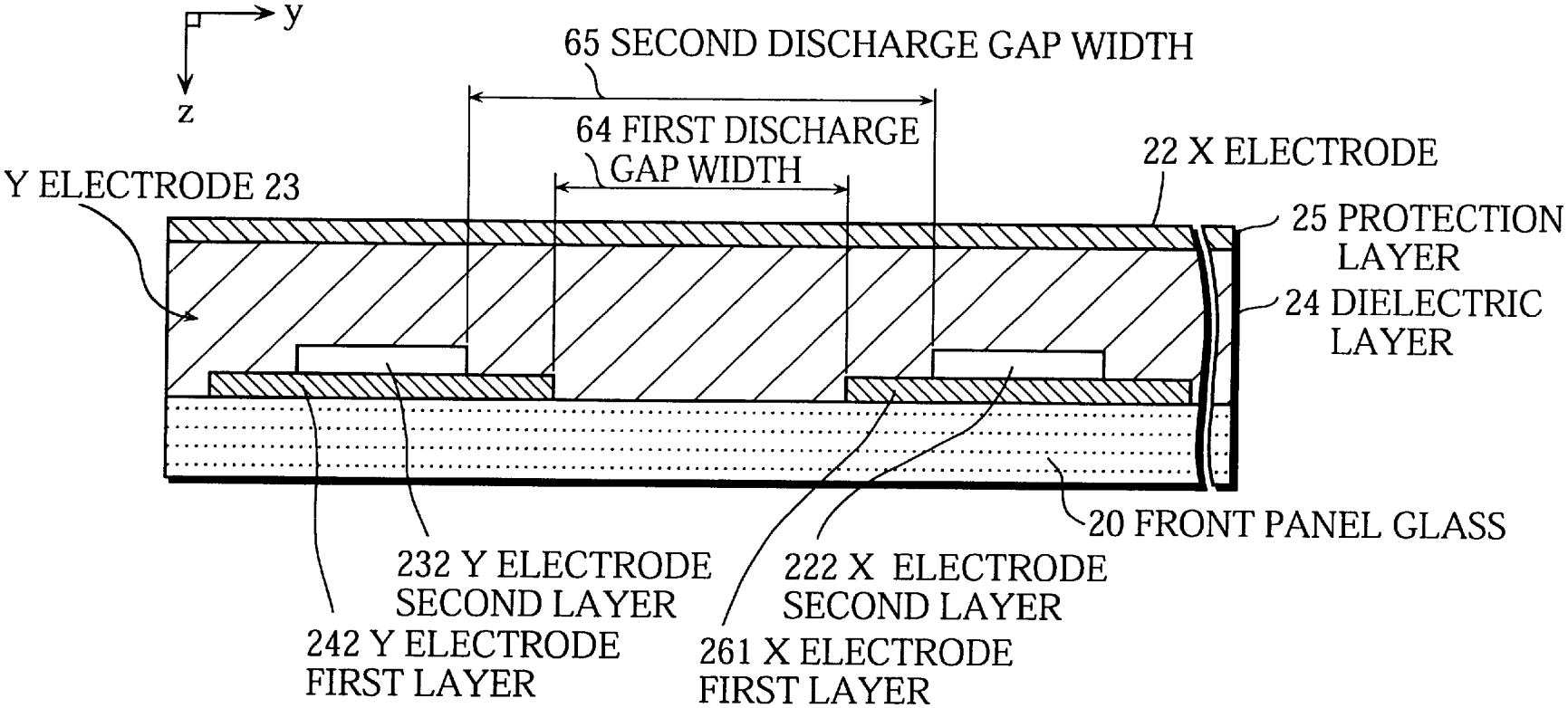
FIG. 18 is a cross sectional view of display electrodes and their periphery of the PDP of Embodiment 5.

FIG. 18 is a partial, cross sectional view of display electrodes and their periphery of the PDP of the present embodiment.

The construction of the present PDP is almost the same as the two-layer construction of Embodiment 2 except that the first layers of the display electrodes are made of a material having higher resistance than the second layers. With this construction, it is difficult for the discharge established in a space having the first discharge gap width to affect the sustain discharge after the initial discharge. As a result, the discharge efficiency is further improved. This will be described in detail.

In the actuation of a typical gas discharge panel such as PDP, charging and discharging the display electrodes are alternately performed repeatedly, with a certain time period for each of the charging and discharging. The time required for charging or discharging load-carrying capacity of a gas discharge panel is typically in a range of approximately several tens nano-seconds to one micro-seconds, although the time value slightly changes depending on load-carrying capacity of the gas discharge panel and a driving circuit. However, when the display electrodes have a resistance equal to or more than a predetermined value, it takes a longer time for charging. This increases the time for starting discharge and reduces the time for sustaining the discharge.

Figure 19:
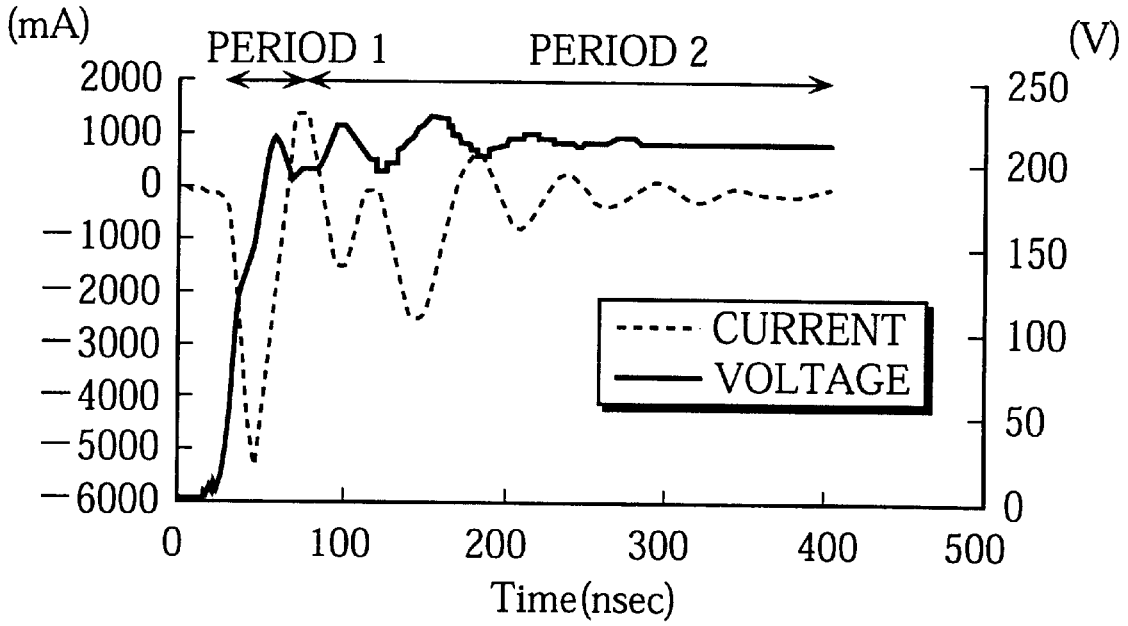
FIG. 19 is a graph showing changes with time of applied current and applied voltage when resistance of display electrodes is low.
Figure 20:
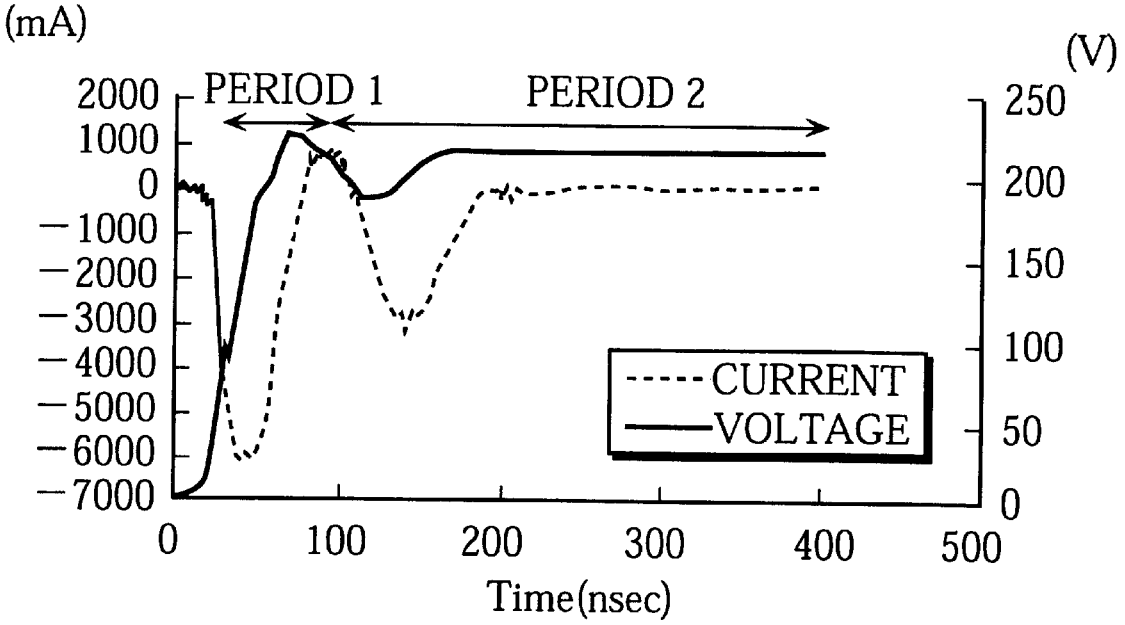
FIG. 20 is a graph showing changes with time of applied current and applied voltage when resistance of display electrodes is high.

FIGS. 19 and 20 respectively show changes in voltage and current over time for a low electric resistance (approximately 10Ω) or less) and for a high electric resistance (approximately 120Ω). In these drawings, the phases of the voltage and current almost match in a charge period before the first discharge is established (period 1) regardless of the level of the electric resistance. However, once the discharge having been established in a pair of display electrodes in the dielectric layer reaches the sustain discharge in discharge space (in the present embodiment, such a discharge is referred to as a space discharge), the current flow suddenly decreases when the electric resistance is high. This lengthens the time for charging. As a result, the space discharge is sustained longer with high electric resistance than with low electric resistance. This is also understood from FIG. 20 showing that in a period after the space discharge starts (period 2), the phases of the voltage waveform and the current waveform are more deviated from each other and the number of peaks is less than in the period 2 of FIG. 19.

Under the above circumstances, it is possible to use different areas corresponding to the discharge types. That is to say, a material of a high resistance value is used for an area which is to be used only for the initial discharge when the discharge is to be established actively; and a material of a low resistance value is used for an area which is to be used for the sustain discharge when the sustain discharge is to be established after the initial discharge.

The construction of the present embodiment will be described in detail. As in Embodiment 2, two-layer display electrodes 22 and 23 are first formed, where each of the first layers 261 and 242 is formed using an electrically conductive oxide with high resistance (approximately several tens kΩ/□) which mainly contains Ca and/or Mg. With this arrangement, the initial discharge is established in a space having the first discharge gap width 64 only at an initial stage of the discharge period. After this, the discharge is actively established in a space having the second discharge gap width 65 between the second layers 222 and 232 with low resistance. As a result, the sustain discharge is established excellently. As apparent from the above, in the present embodiment, the sustain discharge in a space having the second discharge gap width 65 between the second layers 222 and 232 is far easier to be established than the initial discharge in a space having the first discharge gap width 64 between the first layers 261 and 241.

Note that the above resistance can be adjusted by changing the amount of oxygen contained in the electrically conductive oxide. Also, other materials of high resistance may be used, such as thin ITO.

The above effects can be obtained ore or less with resistance of several hundreds Ω/□. However, it is desirable to use resistance of several tens kΩ/□ to obtain clear-cut effects.

Figure 21:
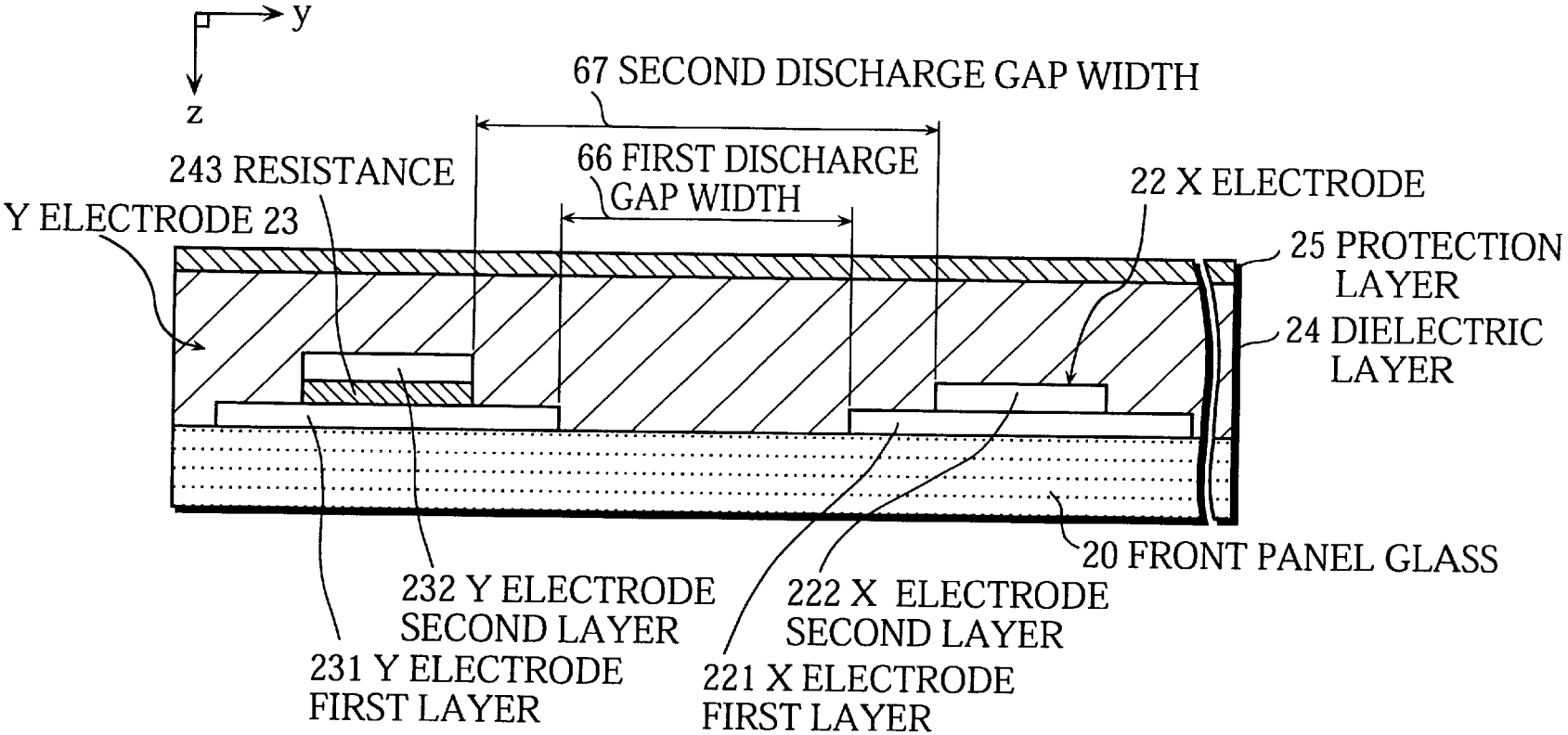
FIG. 21 is a cross sectional view of display electrodes and their periphery of a variation of Embodiment 5.

In one variation of the present embodiment, a resistance 243 is disposed between the first layer 231 and the second layer 232 of the Y electrode 23, and electric current is passed through the Y electrode 23 from the second layer 232, as shown in FIG. 21, a cross-sectional view of the PDP.

Figure 22:
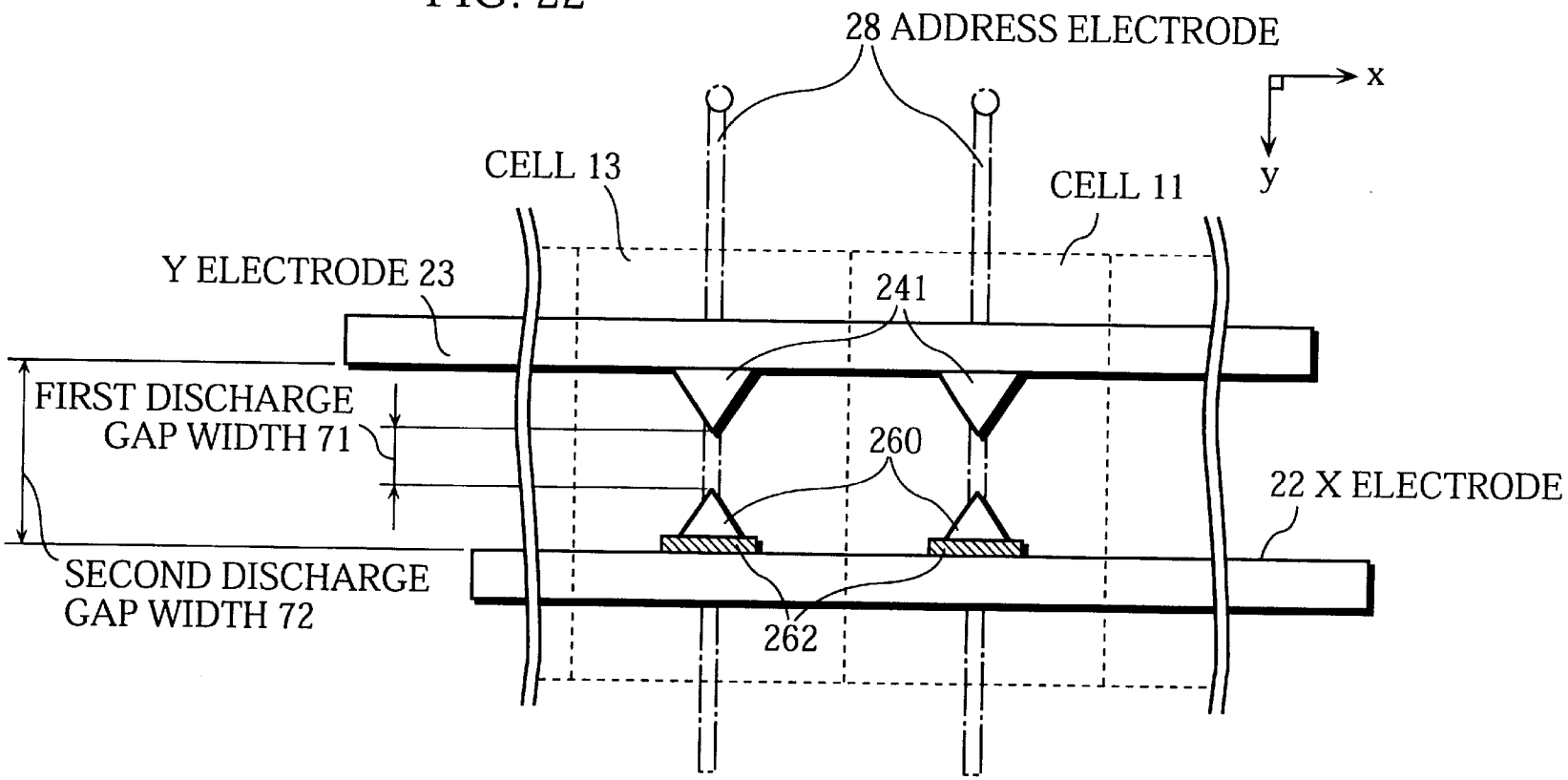
FIG. 22 is a top plan view showing a display electrode disposition pattern of a variation of Embodiment 5.

Another variation is shown in FIG. 22. In FIG. 22 being a top plan view of the PDP's electrode disposition pattern, display electrodes and their periphery of the PDP has the same construction as Embodiment 3 except that resistance 262 are inserted under the bottom of the projections 260. In this way, projections may be used to provide the first and second discharge gap widths.

Setting PDP Discharge Gap and Discharge Gas (Filling Gas) Composition

The present invention is characterized by the first discharge gap width and the second discharge gap width formed between a plurality of display electrodes. Now, prior to the description of manufacturing PDP of each embodiment, a procedure of determining specific values for discharge gap widths will be explained.

i. Discharge Gap and Discharge Gas Composition

In determining discharge gap widths between a plurality of display electrodes suitable for initial discharge and sustain discharge, respectively, a fact that the discharge may be greatly affected by the composition of the discharge gas (filling gas) should be taken into consideration. Therefore, it is desirable to narrow the elements of the discharge gas first. In this example, it is presumed that a typical Ne—Xe base discharge gas is used, and that the percentage of Xe in the Ne—Xe base discharge gas is considered in parallel to the discharge gap widths.

Generally, the discharge gas and the discharge gap width are related to each other as product p·d, where p represents a filling gas pressure (Torr) and d represents a discharge gap width (cm) (refer to "Electric Display Device", Ohm Company, 1984, pp113–114). Therefore, first, a plot of discharge start voltages Vf vs. product p·d and a plot of discharge efficiency (relative value) vs. product p·d are created. Appropriate ranges of product p·d are then selected from the plots. From the selected ranges of product p·d, the percentage of Xe in the discharge gas is determined. The discharge gap width is also determined from the selected ranges of product p·d.

Note that the specific product p·d are measured and obtained with the following method. ps ii. Measuring Discharae Start Voltaae vs. Product p·d and Discharae Efficiency vs. Product p·d AC surface-discharge type PDP models (three types of PDP model respectively having: 40 μm, 60 μm, and 90 μm of discharge gap widths between a pair of display electrodes) with the same driving method as the PDP of the present invention is placed in a vacuum chamber. An arrangement is made so that the PDP model can be driven from outside the vacuum chamber through an aging circuit (pulses to be applied are set to 20 kHz). Also, a gas cylinder is connected from outside to the vacuum chamber via a gate valve so that the discharge gas can be enclosed into the vacuum chamber at a certain pressure at proper times. In the present measurement, PDP models corresponding to the cases in which the percentage of Xe in the discharge gas is 2%, 5%, and 10% were prepared, and these PDP models were actuated with various discharge gas pressures P (i.e., with various product p·d). Note that illustration of these apparatuses for experiment are omitted.

The timing with which the actuated PDP models start emitting light was then detected using a luminance meter, and the applied voltages measured at the timing were recorded as discharge start voltages Vf. With the discharge start voltages Vf on the vertical axis and the product p·d on the horizontal axis, a functional curve known as Paschen's curve which shows a relationship between the discharge start voltage Vf and the product p·d was obtained.

Applied voltages measured when the light vanished after the applied voltage had gradually been decreased after the discharge had become the sustain discharge were recorded as the discharge sustain voltages Vm. Relative-values of discharge efficiency were calculated using each discharge sustain voltage Vm, and with the relative values of discharge efficiency on the vertical axis and the product p·d on the horizontal axis, a functional curve (discharge efficiency curve) showing a relationship between the relative value and the product p·d was obtained. Each discharge efficiency value was calculated using Formula 1 shown below, where Vm represents discharge sustain voltage, I discharge current, L luminance, and S light emission area.

Discharge Efficiency $\eta=\pi\cdot S\cdot L/(Vm\cdot I)$ Formula 1

The Paschen's curve is a downward curve, and the discharge efficiency curve is an upward curve. These curves have peaks respectively being the minimum value $Vf_{min}$ of the discharge start voltage and the maximum value of the discharge efficiency. Two product p·d values are determined from the above two kinds of peaks. Then, a proper range of the product p·d for manufacturing an actual PDP is determined from the two product p·d values. Accordingly, a point to be checked first in determining the product p·d is how clearly the peaks are detected from the curves.

It should be noted here that the Paschen's curve and the discharge efficiency curve with the above shapes are obtained when discharge gases other than the Ne—Xe base discharge gas are used. Also, it is known that the above two curves are obtained in terms of, for example, partial pressure ($P_{xe}$) for the Xe gas in the discharge gas when a discharge gas containing a plurality of elements such as the Ne—Xe base gas.

iii. Measurement Results

Figure 23A:
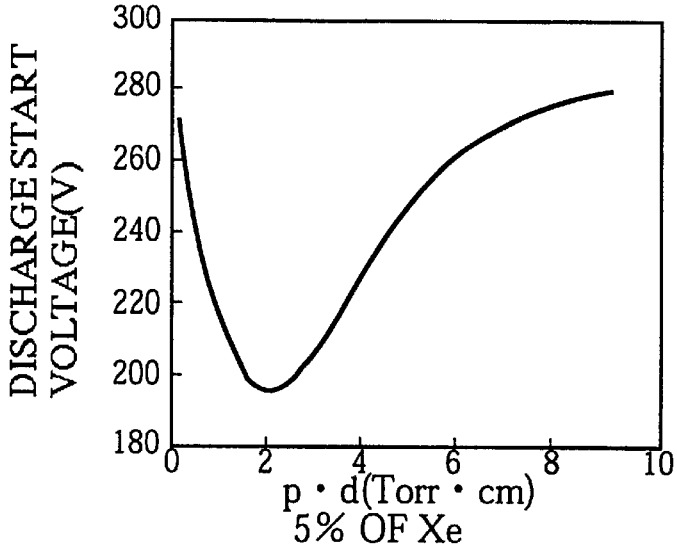
Figure 23C:
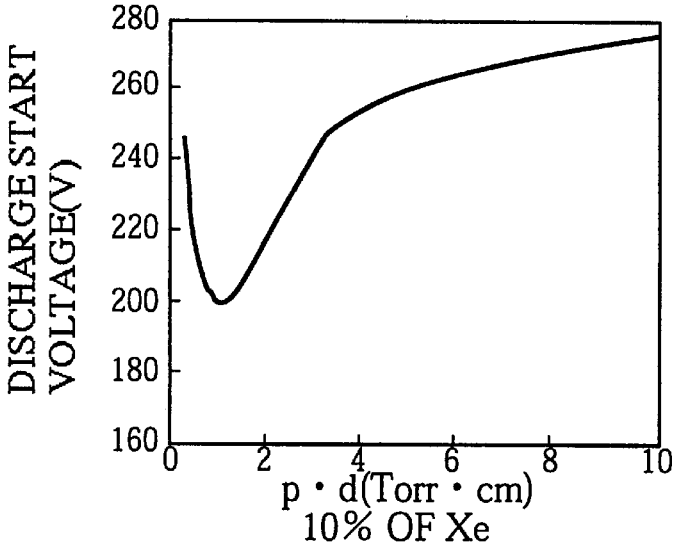
Figure 23C:
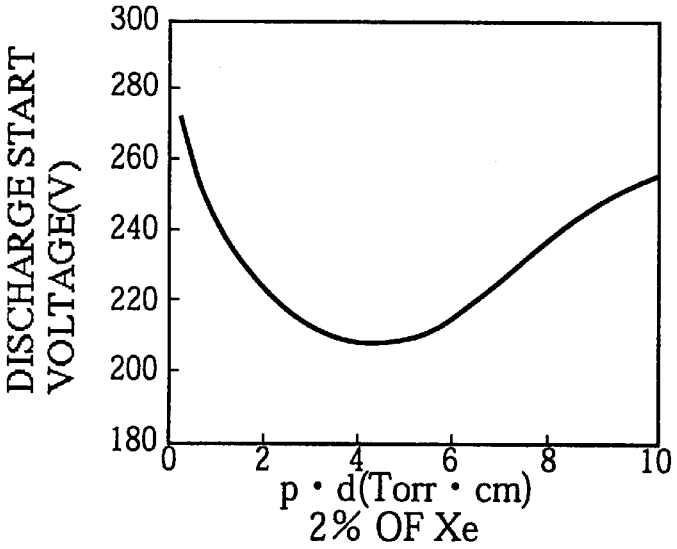
Figure 24A:
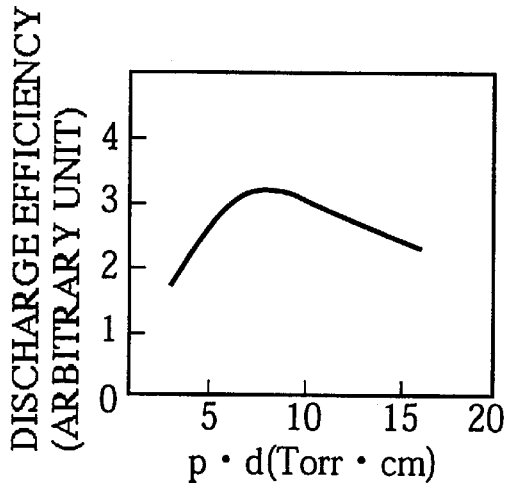
FIGS. 24A, 24B, and 24C are graphs showing characteristics (discharge efficiency curve) of discharge efficiency vs. Product pad.
Figure 24B:
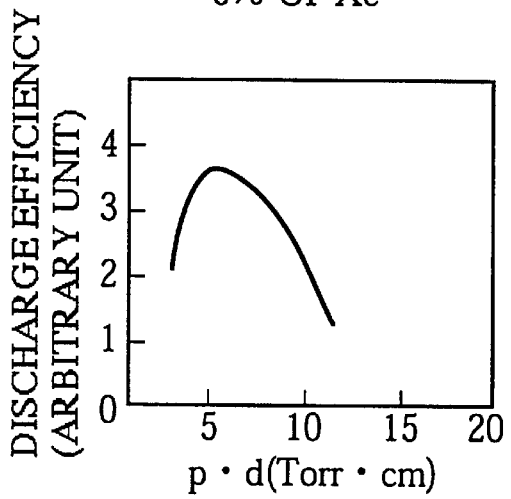
Figure 24C:
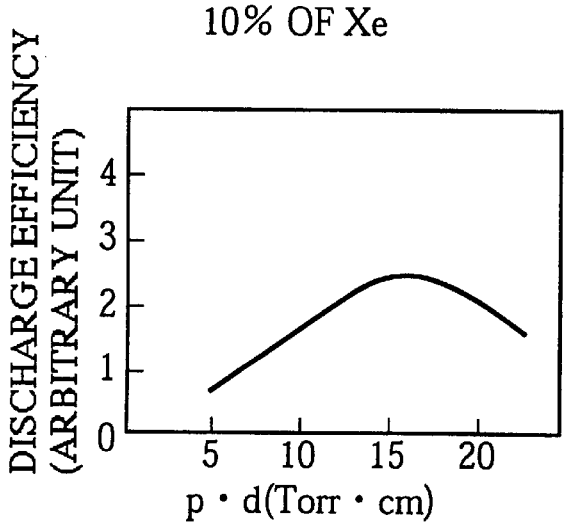

FIGS. 23A, 23B, and 23C show the Paschen's curve. FIGS. 24A, 24B, and 24C show the discharge efficiency curve. FIGS. A, B, and C of these figures respectively correspond to cases where the percentage of Xe in the discharge gas is 5%, 10%, and 2%.

In the Paschen's curve shown in FIG. 23A when the percentage of Xe in the discharge gas is 5%, a relatively acute curve is included in the range of 1 to 5 (Torr·cm) of product p·d determined from a range including $Vf_{min}$. It is also noted that a clear peak is in the range of 2 to 4 (Torr·cm). The range of the product p·d determined from the peak may be narrowed to 2.5 to 3.5 (Torr·cm). In addition, the discharge start voltage Vf is lower than 200 V in a region around the peak. A similarly shaped curve is shown in the Paschen's curve in FIG. 23B when the percentage of Xe in the discharge gas is 10%. However, in this case, a range of product p·d with smaller values (approximately 1 to 3 Torr·cm) is determined from the peak.

In the discharge efficiency curve shown in FIG. 24A when the percentage of Xe in the discharge gas is 5%, a range of product p·d from 4 to 12 (Torr·cm) is determined from approximately the curve's peak. A clear peak is included in a range from 6 to 10 (Torr·cm). A narrower range of a periphery of the peak is from 7 to 9 (Torr·cm). The curve takes values larger than approximately 2.8 starting from a broad range of 4 to 12 (Torr·cm) until the curve reaches the maximum value of approximately 3. In the discharge efficiency curve shown in FIG. 24B when the percentage of Xe in the discharge.gas is 10%, a range of product p·d from 3 to 10 (Torr·cm) is determined from the peak, the maximum value being approximately 3.5. It is observed that a range of product p·d approximately from 4 to 7 (Torr·cm) is determined from the peak.

As understood from the above description, when the percentage of Xe in the discharge gas is 5% or 10%, the peaks of the Paschen's curve and the discharge efficiency curve are relatively easily recognized. As a result, ranges of product p·d respectively determined from the discharge start voltage Vf and the discharge efficiency can be selected, and specific values for the ranges can be determined. Also, when the percentage of Xe in the discharge gas is 5% or 10%, the product p·d determined from each peak is not so large. Accordingly, for example, space for securing the first discharge gap width or the second discharge gap width can be small.

In contrast, as shown in FIG. 23C, when the percentage of Xe in the discharge gas is 2%, a gentle curve is observed around the peak when the product p·d is in a range of 4 to 6 (Torr·cm). As a result, it is difficult to determine a position of a clear peak of the discharge start voltage Vf. Also, since a range of relatively large values of product p·d is determined from a curving portion of the curve, a product p·d determined from the peak is large. Similarly, in the discharge efficiency curve shown in FIG. 24C, a product p·d determined from the peak is larger than a case where the percentage of Xe in the discharge gas is 5% or 10% (the range of product p·d being approximately from 12 to 20 (Torr·cm)).

As the product p·d values for the discharge start voltage Vf and the discharge efficiency increase, higher discharge gas pressure P and large discharge gap width d need to be secured. This is not desirable since it becomes an obstacle to the production of PDPs with highly minute cells.

iv. Determination of Discharge Gap Width and Xe Percentage

As apparent from the above description, it is considered that appropriate percentages of Xe in the Ne—Xe base discharge gas are 5% and 10%. As a next step, either 5% or 10% of Xe is selected. Many of generally used Ne—Xe base discharge gases contain approximately 5% of Xe. Accordingly, it is considered that a discharge gas containing 5% of Xe is most appropriate in manufacturing the PDP of the present embodiment.

The above determination is explained as follows. As described earlier, product p·d suitable for the minimum value $Vf_{min}$ of the discharge start voltage Vf (and the first discharge gap width) can be arranged in the following order of desirableness in accordance with the ranges determined from approximately the peak of the Paschen's curve.

product p·d: 2.5 to 3.5, 2 to 4, 1 to 5 (Torr·cm)

Here, the product p·d can be represented by $p_{xe}$·d product by replacing p with partial pressure $p_{xe}$ of the Xe gas in the discharge gas. The $p_{xe}$·d products are arranged in the following order of desirableness, where $p=20p_{xe}$.

$p_{xe}$·d product: 0.12 to 0.18, 0.10 to 0.20, 0.05 to 0.25 (Torr·cm)

Also, product p·d suitable for the discharge efficiency (and the second discharge gap width) can be arranged in the following order of desirableness in accordance with the ranges determined from approximately the peak of the discharge efficiency curve.

product p·d: 7 to 9, 6 to 10, 4 to 12 (Torr·cm)

Here, when the product p·d is represented by $p_{xe}$·d product, the $p_{xe}$·d products are arranged in the following order of desirableness.

$p_{xe}$·d product: 0.35 to 0.45, 0.30 to 0.50, 0.20 to 0.60 (Torr·cm)

In the present embodiment, taking the above ranges of product p·d into account, the product p·d suitable for the discharge start voltage is set to 4, and the product p·d suitable for the discharge efficiency is set to 8. More specifically, the discharge gas pressure p is set to 2000 Torr, then based on this value, the first discharge gap width is set to 20 $\mu$m ($20\times10^{-4}$ cm), and the second discharge gap width is set to 40 $\mu$m ($40\times10^{-4}$ cm).

It should be noted here that another experiment showed that a discharge gas containing a plurality of elements including Xe is similar to the above Ne—Xe base discharge gas in terms of the two kinds of curves.

INDUSTRIAL APPLICABILITY

As described above, the present invention improves the light emission efficiency and obtains excellent discharge efficiency by securing discharge gap widths in accordance with the initial discharge and sustain discharge in a gas discharge panel such as a PDP.

What is claimed is:

1. A gas discharge panel in which a plurality of cells filled with a discharge gas are arranged as a matrix between a pair of opposed plates, and in which a pair of display electrodes on a surface of one of the pair of opposed plates extend across a plurality of cells in the direction of rows, characterized in that:

a gap between the pair of display electrodes has a first discharge gap width and a second discharge gap width larger than the first discharge gap width, and the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between the product p·d and discharge efficiency, wherein p represents discharge gas pressure and d represents discharge gap width.

2. The gas discharge panel of claim 1, wherein one of the pair of display electrodes is branched into a first electrode prong and a second electrode prong, the other of the pair of display electrodes is positionally between the first electrode prong and the second electrode prong, a gap width between the first electrode prong and the other display electrode is the first discharge gap width, and a gap width between the second electrode prong and the other display electrode is the second discharge gap width.

3. The gas discharge panel of claim 2, wherein the first electrode prong and the second electrode prong are as wide as outer sides of the first electrode prong and the second electrode prong are located close to each boundary between cells adjoining in the direction of columns.

4. The gas discharge panel of claim 1, wherein each of the pair of display electrodes is branched into a plurality of electrode prongs, a predetermined electrode prong of one of the pair of display electrodes is positionally between a first electrode prong and a second electrode prong of the other of the pair of display electrodes, a gap width between the first electrode prong and the predetermined electrode prong is the first discharge gap width, and a gap width between the second electrode prong and the predetermined electrode prong is the second discharge gap width.

5. The gas discharge panel of claim 4, wherein an electrode prong being closest to a cell adjoining in the direction of columns is as wide as an outer side of the electrode prong is located close to a boundary between the adjoining cell and a cell containing the electrode prong.

6. The gas discharge panel of claim 4, wherein electricity is supplied to the first electrode prong via a resistance.

7. The gas discharge panel of claim 1, wherein a gap between the pair of display electrodes has a plurality of gap widths in a direction perpendicular to a surface of the gas discharge panel, the plurality of gap widths including the first discharge gap width and the second discharge gap width.

8. The gas discharge panel of claim 7, wherein at least one of facing sides of the pair of display electrodes is one of slanting, curved, and stepped in a direction perpendicular to a surface of the gas discharge panel.

9. The gas discharge panel of claim 8, wherein at least one of the pair of display electrodes is a stack of a plurality of layers including a resistor layer between which and the other of the pair of display electrodes the first discharge gap width is formed, the stack being formed in a stepped shape in a direction perpendicular to a surface of the gas discharge panel.

10. The gas discharge panel of claim 7, wherein at least one of the pair of display electrodes includes a first electrically conductive material and a second electrically conductive material, the first electrically conductive material being separated from the second electrically conductive material in a direction perpendicular to a surface of the gas discharge panel, the first discharge gap width being formed between the first electrically conductive material and the other of the pair of display electrodes, and the second discharge gap width being formed between the second electrically conductive material and the other of the pair of display electrodes.

11. The gas discharge panel of claim 10, wherein a space between the first electrically conductive material and the second electrically conductive material is filled with a resistor.

12. The gas discharge panel of claim 1, wherein at least one of facing sides of the pair of display electrodes has one or more projections per cell, the first discharge gap width being formed between the one or more projections and the other of the pair of display electrodes, and the second discharge gap width being formed between the other of the pair of display electrodes and the at least one of facing sides of the pair of display electrodes at portions other than the one or more projections.

13. The gas discharge panel of claim 12, wherein at least base part of the one or more projections is made of a resistance material.

14. The gas discharge panel of claim 1, wherein the first discharge gap width is set so that the product of the discharge gas pressure and the discharge gap width is in a range of 1 to 5 (Torr·cm).

15. The gas discharge panel of claim 1, wherein the first discharge gap width is set so that the product of the discharge gas pressure and the discharge gap width is in a range of 2 to 4 (Torr·cm).

16. The gas discharge panel of claim 1, wherein the first discharge gap width is set so that the product of the discharge gas pressure and the discharge gap width is in a range of 2.5 to 3.5 (Torr·cm).

17. The gas discharge panel of claim 1, wherein the discharge gas contains Xe and the first discharge gap width is set so that the product of a partial pressure of Xe gas in the discharge gas pressure and the discharge gap width is in a range of 0.02 to 0.10 (Torr·cm).

18. The gas discharge panel of claim 1, wherein the discharge gas contains Xe and the first discharge gap width is set so that the product of a partial pressure of Xe gas in the discharge gas pressure and the discharge gap width is in a range of 0.04 to 0.08 (Torr·cm).

19. The gas discharge panel of claim 1, wherein the discharge gas contains Xe and the first discharge gap width is set so that the product of a partial pressure of Xe gas in the discharge gas pressure and the discharge gap width is in a range of 0.05 to 0.07 (Torr·cm).

20. The gas discharge panel of claim 1, wherein the second discharge gap width is set so that the product of the discharge gas pressure and the discharge gap width is in a range of 4 to 12 (Torr·cm).

21. The gas discharge panel of claim 1, wherein the second discharge gap width is set so that the product of the discharge gas pressure and the discharge gap width is in a range of 6 to 10 (Torr·cm).

22. The gas discharge panel of claim 1, wherein the second discharge gap width is set so that the product of the discharge gas pressure and the discharge gap width is in a range of 7 to 9 (Torr·cm).

23. The gas discharge panel of claim 1, wherein the discharge gas contains Xe and the second discharge gap width is set so that the product of a partial pressure of Xe gas in the discharge gas pressure and the discharge gap width is in a range of 0.1 to 0.3 (Torr·cm).

24. The gas discharge panel of claim 1, wherein the discharge gas contains Xe and the second discharge gap width is set so that the product of a partial pressure of Xe gas in the discharge gas pressure and the discharge gap width is in a range of 0.15 to 0.25 (Torr·cm).

25. The gas discharge panel of claim 1, wherein the discharge gas contains Xe and the second discharge gap width is set so that the product of a partial pressure of Xe gas in the discharge gas pressure and the discharge gap width is in a range of 0.16 to 0.20 (Torr·cm).

26. A gas discharge panel in which a plurality of cells filled with a discharge gas are arranged as a matrix between a pair of opposed plates, and in which a pair of display electrodes on a surface of one of the pair of opposed plates extend across a plurality of cells in the direction of rows, characterized in that:

an intermediate electrode is positionally between the pair of display electrodes, the intermediate electrode being electrically insulated from the pair of display electrodes, a sum of gap widths between the intermediate electrode and the pair of display electrodes being a first discharge gap width, and a gap width between the pair of display electrodes being a second discharge gap width larger than the first discharge gap width, and the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between product pod and discharge efficiency, wherein p represents discharge gas pressure, and d represents discharge gap width.

27. The gas discharge panel of claim 26, wherein the first discharge gap width is set so that the product of the discharge gas pressure and the discharge gap width is in a range of 1 to (Torr·cm).

28. The gas discharge panel of claim 26, wherein the first discharge gap width is set so that the product of the discharge gas pressure and the discharge gap width is in a range of 2 to 4 (Torr·cm).

29. The gas discharge panel of claim 26, wherein the first discharge gap width is set so that the product of the discharge gas pressure and the discharge gap width is in a range of 2.5 to 3.5 (Torr·cm).

30. The gas discharge panel of claim 26, wherein the discharge gas contains Xe. and the first discharge gap width is set so that the product of a partial pressure of Xe gas in the discharge gas pressure and the discharge gap width is in a range of 0.02 to 0.10 (Torr·cm).

31. The gas discharge panel of claim 26, wherein the discharge gas contains Xe and the first discharge gap width is set so that the product of a partial pressure of Xe gas in the discharge gas pressure and the discharge gap width is in a range of 0.04 to 0.08 (Torr·cm).

32. The gas discharge panel of claim 26, wherein the discharge gas contains Xe and the first discharge gap width is set so that the product of a partial pressure of Xe gas in the discharge gas pressure and the discharge gap width is in a range of 0.05 to 0.07 (Torr·cm).

33. The gas discharge panel of claim 26, wherein the second discharge gap width is set so that the product of the discharge gas pressure and the discharge gap width is in a range of 4 to 12 (Torr·cm).

34. The gas discharge panel of claim 26, wherein the second discharge gap width is set so that the product of the discharge gas pressure and the discharge gap width is in a range of 6 to 10 (Torr·cm).

35. The gas discharge panel of claim 26, wherein the second discharge gap width is set so that the product of the discharge gas pressure and the discharge gap width is in a range of 7 to 9 (Torr·cm).

36. The gas discharge panel of claim 26, wherein the discharge gas contains Xe and the second discharge gap width is set so that the product of a partial pressure of Xe gas in the discharge gas pressure and the discharge gap width is in a range of 0.1 to 0.3 (Torr·cm).

37. The gas discharge panel of claim 26, wherein the discharge gas contains Xe and the second discharge gap width is set so that the product of a partial pressure of Xe gas in the discharge gas pressure and the discharge gap width is in a range of 0.15 to 0.25 (Torr·cm).

38. The gas discharge panel of claim 26, wherein the discharge gas contains Xe and the second discharge gap width is set so that the product of a partial pressure of Xe gas in the discharge gas pressure and the discharge gap width is in a range of 0.16 to 0.20 (Torr·cm).

39. A gas discharge panel in which a plurality of cells filled with a discharge gas are arranged as a matrix between a pair of opposed plates, and in which a first display electrode, a second display electrode, and a third display electrode on a surface of one of the pair of opposed plates extend across a plurality of cells in the direction of rows, characterized in that:

a gap between the first display electrode and the second display electrode has a first discharge gap width, and a gap between the first display electrode and the third display electrode has a second discharge gap width larger than the first discharge gap width, and the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between product pad and discharge efficiency, wherein p represents discharge gas pressure, and d represents discharge gap width, and at actuation, electricity is supplied at an initial stage of a discharge sustain period to the first and second display electrodes and electricity is supplied for the rest of the discharge sustain period to the first and third display electrodes.

40. The gas discharge panel of claim 39, wherein each of the first display electrode, the second display electrode, and the third display electrode is branched into a plurality of electrode prongs which are disposed in a predetermined pattern so that each of the plurality of electrode prongs of one display electrode is positionally between electrode prongs of other display electrodes.

41. A gas discharge panel in which a front cover plate is opposed to a back plate, a plurality of cells filled with a discharge gas are arranged as a matrix between the front cover plate and the back plate, a pair of display electrodes on a surface of one of the opposed front cover plate and back plate extend across a plurality of cells in the direction of rows, and a dielectric layer is disposed on the pair of display electrodes, characterized in that:

a gap between the pair of display electrodes has a first discharge gap width and a second discharge gap width larger than the first discharge gap width, and the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between product p·d and discharge efficiency, wherein p represents discharge gas pressure and d represents discharge gap width.

42. The gas discharge panel of claim 41, wherein one of the pair of display electrodes is branched into a first electrode prong and a second electrode prong, the other of the pair of display electrodes is positionally between the first electrode prong and the second electrode prong, a gap width between the first electrode prong and the other display electrode is the first discharge gap width, and a gap width between the second electrode prong and the other display electrode is the second discharge gap width.

43. The gas discharge panel of claim 41, wherein each of the pair of display electrodes is branched into a plurality of electrode prongs, an electrode prong of one of the pair of display electrodes is positionally between a first electrode prong and a second electrode prong of the other of the pair of display electrodes, a gap width between the first electrode prong and the electrode prong positionally between the first electrode prong and the second electrode prong is the first discharge gap width, and a gap width between the second electrode prong and the electrode prong positionally between the first electrode prong and the second electrode prong is the second discharge gap width.

44. The gas discharge panel of claim 41, wherein a gap between the pair of display electrodes has a plurality of gap widths in a direction perpendicular to a surface of the gas discharge panel, the plurality of gap widths including the first discharge gap width and the second discharge gap width.

45. The gas discharge panel of claim 41, wherein at least one of the pair of display electrodes includes a first electrically conductive material and a second electrically conductive material wider than the first electrically conductive material, the first electrically conductive material being separated from the second electrically conductive material in a direction perpendicular to a surface of the gas discharge panel, the second discharge gap width being formed between the first electrically conductive material and the other of the pair of display electrodes, and the first discharge gap width being formed between the second electrically conductive material and the other of the pair of display electrodes.

46. A gas discharge panel in which a plurality of cells filled with a discharge gas are arranged as a matrix between a pair of opposed plates, and in which a pair of display electrodes on a surface of one of the pair of opposed plates extend across a plurality of cells in the direction of rows, characterized in that:

a gap between the pair of display electrodes has a first discharge gap width and a second discharge gap width larger than the first discharge gap width, the first discharge gap width is determined from approximately the minimum discharge start voltage in a Paschen's curve which shows a relationship between product p·d and discharge start voltage, and the second discharge gap width is determined from the maximum discharge efficiency in a discharge efficiency curve which shows a relationship between the product p·d and discharge efficiency, wherein p represents discharge gas pressure and d represents discharge gap width, and the display electrodes are composed of pairs of a first polarity electrode and a second polarity electrode are arranged in parallel to form the first and second discharge gaps and different numbers of first polarity electrodes and second polarity electrodes correspond to each cell for the matrix display.

47. The gas discharge panel of claim 46, wherein two display electrodes disposed at both ends in a direction of columns of matrix, among a plurality of display electrodes corresponding to each cell, have a polarity which does not relate to data writing.

48. The gas discharge panel of claim 47, wherein two opposed display electrodes at ends of each pair of cells adjoining in the direction of columns of matrix either are in intimate contact or have an exceedingly small gap in between.

49. A gas discharge panel in which a plurality of cells filled with a discharge gas are arranged as a matrix between a pair of opposed plates, and in which a pair of display electrodes on a surface of one of the pair of opposed plates extend across a plurality of cells in the direction of rows, characterized in that:

a gap between the pair of display electrodes has a first discharge gap width and a second discharge gap width lager than the first discharge gap width, the first discharge gap width is determined from approximately the minimum start voltage in a Paschen's curve which shows a relationship between product p·d and discharge start voltage, and the second discharge gap width is determined from the maximum discharge efficiency in a discharge efficiency curve which shows a relationship between the product p·d and discharge efficiency, wherein p represents discharge gas pressure and d represents discharge gap width, and the display electrodes include pairs of a first polarity electrode and a second polarity electrode are arranged in parallel to form the first and second discharge gaps and two display electrodes disposed at both ends in a direction of columns of matrix, among a plurality of display electrodes corresponding to each cell, have a same polarity.

50. The gas discharge panel of claim 49, wherein two display electrodes disposed at both ends in a direction of columns of matrix, among a plurality of display electrodes corresponding to each cell, have a polarity which does not relate to data writing.

51. The gas discharge panel of claim 50, wherein two opposed display electrodes at ends of each pair of cells adjoining in the direction of columns of matrix either are in intimate contact or have an exceedingly small gap in between.

* * * * *